US008181992B2

(12) United States Patent
Mulhern et al.

(10) Patent No.: US 8,181,992 B2
(45) **Date of Patent: *May 22, 2012**

(54) ANTI-TIP SYSTEM FOR A POWER WHEELCHAIR

(75) Inventors: James P. Mulhern, Nanticoke, PA (US); Ronald Levi, Courtdale, PA (US); Christopher E. Grymko, Plains, PA (US)

(73) Assignee: Pride Mobility Products Corporation, Exeter, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/010,006

(22) Filed: Jan. 20, 2011

(65) Prior Publication Data

US 2011/0108348 A1 May 12, 2011

Related U.S. Application Data

(63) Continuation of application No. 12/780,318, filed on May 14, 2010, now Pat. No. 7,931,300, which is a continuation of application No. 12/170,876, filed on Jul. 10, 2008, now Pat. No. 7,726,689, which is a continuation of application No. 11/180,207, filed on Jul. 13, 2005, now Pat. No. 7,413,038, which is a continuation-in-part of application No. 10/962,014, filed on Oct. 8, 2004, now Pat. No. 7,389,835.

(60) Provisional application No. 60/509,649, filed on Oct. 8, 2003, provisional application No. 60/509,495, filed on Oct. 8, 2003.

(51) Int. Cl.
*A61G 5/04* (2006.01)

(52) U.S. Cl. ..... 280/755; 180/907; 180/908

(58) Field of Classification Search ..... 280/755, 280/250.1, 304.1, 47.16, DIG. 10; 180/907, 180/908

See application file for complete search history.

(56) References Cited

U.S. PATENT DOCUMENTS 3,104,112 A 9/1963 Crail
3,520,378 A 7/1970 Slay (Continued)

FOREIGN PATENT DOCUMENTS

EP 1 522 295 A2 4/2005

(Continued)

OTHER PUBLICATIONS

Photographs—Sunrise Medical G-424 (Sold from Oct. 1999).

(Continued)

*Primary Examiner* — Drew Brown
(74) *Attorney, Agent, or Firm* — Flaster/Greenberg P.C.

(57) ABSTRACT

An anti-tip system is provided for improving the stability of a powered vehicle, such as a powered wheelchair. The vehicle includes a drive-train assembly pivotally mounted to a main structural frame. A suspension system biases the drive-train assembly and its connected anti-tip wheel to a predetermined resting position. The drive-train assembly bi-directionally rotates about a pivot in response to torque applied to or acceleration forces on the vehicle. A linkage arrangement is provided and is characterized by a suspension arm pivotally mounting to the main structural frame about a pivot at one end thereof and an anti-tip wheel at the other end. The linkage may further include at least one link operable to transfer the bi-directional displacement of the drive-train assembly to the suspension arm. The link may include a bell crank member and/or may be resiliently compressible.

21 Claims, 19 Drawing Sheets

U.S. PATENT DOCUMENTS

| | | | | |
|---|---|---|---|---|
| 3,827,718 | A | 8/1974 | Curry | |
| 4,000,912 | A | 1/1977 | Donald et al. | |
| 4,128,137 | A | 12/1978 | Booth | |
| 4,245,847 | A | 1/1981 | Knott | |
| 4,513,832 | A | 4/1985 | Engman | |
| 4,840,394 | A | 6/1989 | Bickler | |
| 5,435,404 | A | 7/1995 | Garin, III | |
| 5,564,512 | A | 10/1996 | Scheulderman | |
| 5,772,237 | A | 6/1998 | Finch et al. | |
| 5,848,658 | A | 12/1998 | Pulver | |
| 5,855,387 | A | 1/1999 | Gill et al. | |
| 5,964,473 | A | 10/1999 | Degonda et al. | |
| 6,047,979 | A | 4/2000 | Kraft et al. | |
| 6,070,898 | A | 6/2000 | Dickie et al. | |
| 6,129,165 | A | 10/2000 | Schaffner et al. | |
| 6,135,222 | A | 10/2000 | Furukawa | |
| 6,196,343 | B1 | 3/2001 | Strautnieks | |
| 6,220,382 | B1 | 4/2001 | Kramer et al. | |
| 6,234,507 | B1 | 5/2001 | Dickie et al. | |
| 6,341,657 | B1 | 1/2002 | Hopely et al. | |
| 6,357,793 | B1 | 3/2002 | Dickie et al. | |
| 6,460,641 | B1 | 10/2002 | Kral | |
| 6,533,306 | B2 | 3/2003 | Watkins | |
| 6,543,798 | B2 | 4/2003 | Schaffner et al. | |
| 6,554,086 | B1 | 4/2003 | Goertzen et al. | |
| 6,705,629 | B2 | 3/2004 | Post et al. | |
| 6,752,230 | B1 | 6/2004 | Huang | |
| 6,796,568 | B2 | 9/2004 | Martis et al. | |
| 6,851,711 | B2 | 2/2005 | Goertzen et al. | |
| 6,923,278 | B2 | 8/2005 | Mulhern et al. | |
| 7,021,641 | B2 | 4/2006 | Wu | |
| 7,040,429 | B2 | 5/2006 | Molnar | |
| 7,083,195 | B2 | 8/2006 | Goertzen et al. | |
| 7,104,346 | B2 | 9/2006 | Schaffner | |
| 7,344,155 | B2 | 3/2008 | Mulhern et al. | |
| 7,726,689 | B2 | 6/2010 | Mulhern et al. | |
| 7,931,300 | B2 * | 4/2011 | Mulhern et al. | 280/755 |
| 2002/0093172 | A1 | 7/2002 | Watkins | |
| 2003/0075365 | A1 | 4/2003 | Fought | |
| 2004/0004342 | A1 | 1/2004 | Mulhern et al. | |
| 2004/0035627 | A1 | 2/2004 | Richey et al. | |
| 2004/0046358 | A1 | 3/2004 | White et al. | |
| 2004/0060748 | A1 | 4/2004 | Molnar | |
| 2004/0168839 | A1 | 9/2004 | Wu | |
| 2004/0251649 | A1 | 12/2004 | Wu | |
| 2004/0262859 | A1 | 12/2004 | Turturiello et al. | |
| 2005/0000742 | A1 | 1/2005 | Mulhern et al. | |
| 2005/0077714 | A1 | 4/2005 | Mulhern et al. | |
| 2005/0077715 | A1 | 4/2005 | Mulhern et al. | |
| 2005/0127631 | A1 | 6/2005 | Schaffer | |
| 2005/0206149 | A1 | 9/2005 | Mulhern et al. | |
| 2006/0022445 | A1 | 2/2006 | Mulhern et al. | |
| 2006/0076747 | A1 | 4/2006 | Pauls et al. | |
| 2006/0076748 | A1 | 4/2006 | Pauls et al. | |
| 2006/0082117 | A1 | 4/2006 | Turturiello et al. | |
| 2006/0086554 | A1 | 4/2006 | Jackson et al. | |
| 2007/0181353 | A1 | 8/2007 | Puskar-Pasewicz et al. | |

FOREIGN PATENT DOCUMENTS

| | | |
|---|---|---|
| FR | 2215054 | 3/1979 |
| FR | 2399822 | 3/1979 |
| GB | 2 051 702 | 5/1980 |
| GB | 2 192 595 | 7/1986 |
| JP | 2001104391 | 4/2001 |
| WO | WO 87/06205 | 4/1978 |
| WO | WO 90/06097 | 11/1989 |
| WO | WO 00/08910 | 9/2000 |
| WO | WO 00/54718 | 9/2000 |

OTHER PUBLICATIONS

Presentation—NSM Symposium (Jul. 2004).

EP Search Report EP 1 522 295 A3.

* cited by examiner

ANTI-TIP SYSTEM FOR A POWER WHEELCHAIR

RELATED APPLICATIONS

The present application is a continuation of copending U.S. application Ser. No. 12/780,318, filed May 14, 2010, which is a continuation of U.S. Pat. No. 7,726,689, issued Jun. 1, 2010, which is a continuation of U.S. Pat. No. 7,413,038, issued Aug. 19, 2008, which is a continuation-in-part of U.S. Pat. No. 7,389,835, issued Jul. 24, 2008, which claims the benefit of the filing date of U.S. Provisional Application No. 60/509,649, filed Oct. 8, 2003, and U.S. Provisional Application No. 60/509,495, filed Oct. 8, 2003; each of said patents and applications herein being incorporated by reference.

TECHNICAL FIELD

The present invention relates to active anti-tip systems for powered vehicles, such as powered wheelchairs, and, more particularly, to a linkage arrangement for providing improved curb-climbing capability and/or pitch stability.

BACKGROUND OF THE INVENTION

Self-propelled or powered wheelchairs have vastly improved the mobility/transportability of the disabled and/or handicapped. One particular system which has gained widespread popularity/acceptance is mid-wheel drive powered wheelchairs, and more particularly, such powered wheelchairs with anti-tip systems. Mid-wheel powered wheelchairs are designed to position the drive wheels, i.e., the rotational axes thereof, slightly forward of the occupant's center of gravity to provide enhanced mobility and maneuverability. Anti-tip systems enhance stability of the wheelchair about its pitch axis and, in some of the more sophisticated anti-tip designs, improve the obstacle or curb-climbing ability of the wheelchair. Such mid-wheel powered wheelchairs and/or powered wheelchairs having anti-tip systems are disclosed in Schaffner et al. U.S. Pat. Nos. 5,944,131 and 6,129,165, both assigned to Pride Mobility Products Corporation of Exeter, Pa.

The Schaffner '131 patent discloses a mid-wheel drive wheelchair having a passive anti-tip system. The passive anti-tip system functions principally to stabilize the wheelchair about its pitch axis, i.e., to prevent forward tipping of the wheelchair. The anti-tip wheel is pivotally mounted to a vertical frame support about a pivot point that lies above the rotational axis of the anti-tip wheel. As such, the system requires that the anti-tip wheel contact a curb or other obstacle at a point below its rotational axis to cause the wheel to flex upwardly and climb over the obstacle. A resilient suspension is provided to support the anti-tip wheel.

The Schaffner '165 patent discloses a mid-wheel drive powered wheelchair having an anti-tip system which is "active" in contrast to the passive system discussed previously and disclosed in the '131 patent. Such anti-tip systems are responsive to accelerations or decelerations of the wheelchair to actively vary the position of the anti-tip wheels, thereby improving the wheelchair's stability and its ability to climb curbs or overcome obstacles. More specifically, the active anti-tip system mechanically couples the suspension system of the anti-tip wheel to the drive-train assembly such that the anti-tip wheels displace upwardly or downwardly as a function of the magnitude of torque applied to the drive-train assembly.

FIG. 1 is a schematic of an anti-tip system A disclosed in the Schaffner '165 patent. In this embodiment the drive-train and suspension systems, are mechanically coupled by a longitudinal suspension arm B, pivotally mounted to the main structural frame C about a pivot point D. At one end of the suspension arm B is mounted a drive-train assembly E, and at the other end is mounted an anti-tip wheel F. In operation, torque created by the drive-train assembly E and applied to the drive wheel G results in relative rotational displacement between the drive-train assembly E and the frame C about the pivot D. The relative motion therebetween, in turn, affects rotation of the suspension arm B about its pivot D in a clockwise or counterclockwise direction depending upon the direction of the applied torque. That is, upon an acceleration, or increased torque input (as may be required to overcome or climb an obstacle), counterclockwise rotation of the drive-train assembly E will occur, creating an upward vertical displacement of the respective anti-tip wheel F. Consequently, the anti-tip wheel F is "actively" lifted or raised to facilitate such operational modes, e.g., curb climbing. Alternatively, deceleration causes a clockwise rotation of the drive-train assembly E, thus creating a downward vertical displacement of the respective anti-tip wheel F. As such, the downward motion of the anti-tip wheel F assists to stabilize the wheelchair when traversing downwardly sloping terrain or a sudden declaration of the wheelchair. Here again, the anti-tip system "actively" responds to a change in applied torque to vary the position of the anti-tip wheel F.

The active anti-tip system disclosed in the Schaffner patent '165 offers significant advances by comparison to prior art passive systems. However, the one piece construction of the suspension arm B, with its single pivot connection D, necessarily requires that both the drive-train assembly E and the anti-tip wheel F inscribe the same angle (the angles are identical). As such, the arc length or vertical displacement of the anti-tip wheel F may be limited by the angle inscribed by the drive-train assembly E, i.e., as a consequence of the fixed proportion.

Moreover, an examination of the relationship between the location of the pivot or pivot axis D and the rotational axis of the anti-tip wheel F reveals that when the anti-tip wheel F impacts an obstacle at or near a point, which is horizontally in-line with the wheel's rotational axis, the anti-tip wheel F may move downwardly. That is, as a result of the position of the pivot D being relatively above the axis of the anti-tip wheel F, a force couple may tend to rotate the suspension atm B downwardly, contrary to a desired upward motion for climbing curbs and/or other obstacles.

SUMMARY OF THE INVENTION

A linkage arrangement is provided for an active anti-tip system within a powered wheelchair. A drive-train assembly is pivotally mounted to a main structural frame of the wheelchair and a suspension system for biasing the drive-train assembly and the anti-tip wheel to a predetermined resting position. The drive-train assembly bi-directionally rotates about the pivot in response to torque applied by or to the assembly. The linkage arrangement includes a suspension arm pivotally mounted to the main structural frame about a pivot at one end thereof and an anti-tip wheel mounted about a rotational axis at the other end. The linkage further includes at least one link operable to transfer the displacement of the drive-train assembly to the suspension arm. Preferably, the rotational axis of the anti-tip wheel is preferably spatially located at a vertical position that is substantially equal to or above the vertical position of the pivot.

In another aspect of the invention, the linkage arrangement is provided with at least one suspension spring to create a biasing force that sets the normal rest position for the linkage and a restoring force for returning the linkage back to its normal position. The spring may be disposed forwardly of the pivot of the drive-train assembly and engages the frame at one end and may also be aligned vertically above the link and supports the suspension arm and the drive assembly.

In another aspect of the invention, the linkage may include a bell crank pivotably secured to the frame. The bell crank linkage serves to transfer the motion for the drive-train assembly to the anti-tip wheels and may amplify the motion by adjustment of the size of the legs of the crank.

BRIEF DESCRIPTION OF THE DRAWINGS

For the purpose of illustrating the invention, there is shown in the drawings various forms that are presently preferred; it being understood, however, that this invention is not limited to the precise arrangements and constructions particularly shown.

DETAILED DESCRIPTION OF THE DRAWINGS

Figure 1:
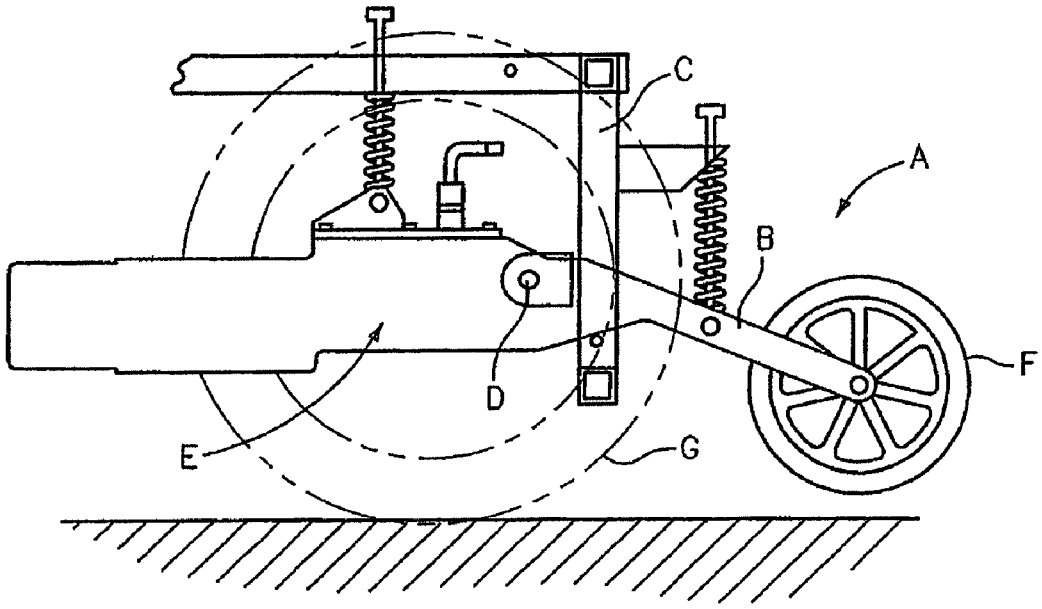
FIG. 1 is a schematic view of an example of a prior art active anti-tip system for use in powered vehicles.
Figure 2:
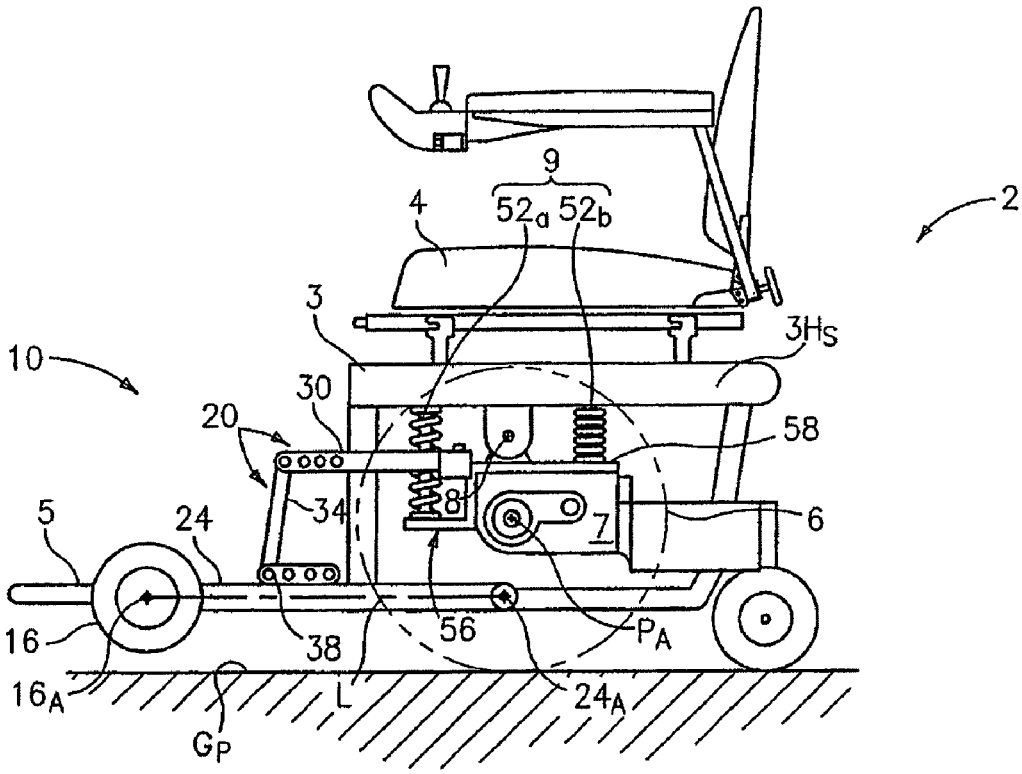
FIG. 2 is a partial side view of a linkage arrangement within a powered vehicle having one of its drive-wheels removed to more clearly show the present invention.

Referring now to the drawings wherein like reference numerals identify like elements, components, subassemblies etc., FIG. 2 depicts a power wheelchair 2 including an active anti-tip system linkage 20 according to the present invention. The linkage 20 may be employed in any vehicle, such as a powered wheelchair, which potentially benefits from stabilization about a pitch axis $P_A$, or enables/controls large angular excursions in relation to a ground plane G. In the embodiment shown in this FIG. 2, the wheelchair 2 comprises an anti-tip system identified generally by the numeral 10, a main structural frame 3, a seat 4 for supporting a wheelchair occupant (not shown), a footrest assembly 5 for supporting the feet and legs (also not shown) of the occupant, and a pair a drive wheels 6 (shown schematically) each being independently controlled and driven by a drive-train assembly 7. Each drive-train assembly 7 is pivotally mounted to the main structural frame 3 about a pivot 8 to affect relative rotation therebetween in response to positive or negative acceleration or torque. Further, a suspension assembly 9 is provided for biasing the drive-train assembly 7 and anti-tip system 10 generally to a predetermined operating position.

Figure 3:
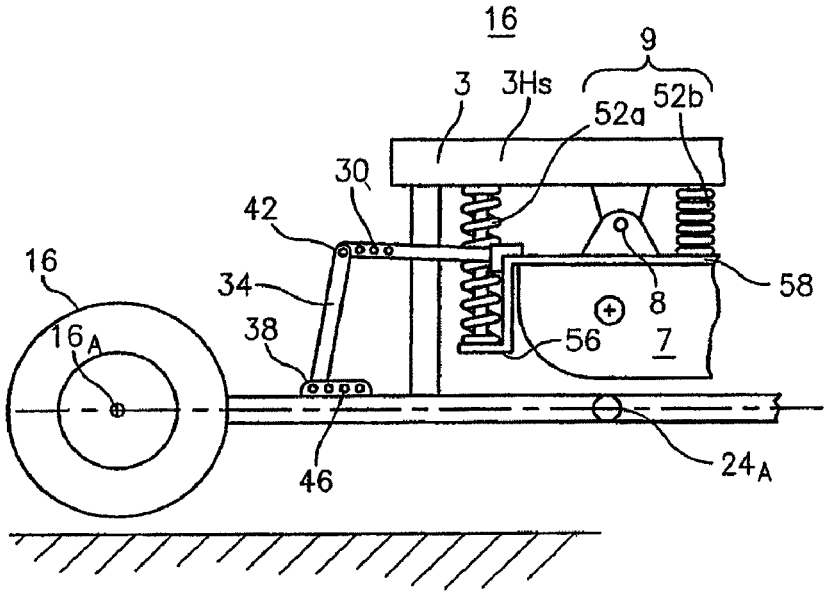
FIG. 3 is an enlarged partial side view of the linkage arrangement of the embodiment of FIG. 2.

The linkage 20 of the present invention is defined as the elements between the drive-train assembly 7 and the pivot or suspension arm supporting the anti-tip wheel 16. Referring also to FIG. 3, the anti-tip wheel 16 is mounted for rotation about axis $\mathbf{16}_A$ which lies substantially at or above the vertical position of the pivot or pivot axis $\mathbf{24}_A$ for the suspension arm 24 on the main structural frame 3. A link 34 is operably connected to the drive-train assembly 7 at one end and to the suspension arm 24 at the other end. The link 34 acts to transfer bi-directional displacement of the drive-train assembly 7 to the suspension arm 24. In the context used herein, the phrase "substantially at or above" means that the pivot $\mathbf{24}_A$ is located at a vertical position (relative to a ground plane $G_P$) that is substantially equal to or less than the vertical position of the rotational axis $\mathbf{16}_A$ of the anti-tip wheel 16 (relative to the ground plane $G_P$). Furthermore, these spatial relationships are defined in terms of the "resting" position of the system 10, when the loads acting on the suspension arm 24 or anti-tip wheel 16 are in equilibrium.

In addition, the pivot $\mathbf{24}_A$ is distally spaced from the rotational axis $\mathbf{16}_A$ of the anti-tip wheel 16. As illustrated, the pivot $\mathbf{24}_A$ is disposed inboard of the forward portions of the main structural frame 3 and is proximal to the position of the drive wheel axis (also called the pitch axis) $P_A$.

In the present embodiment, a bracket 30 is rigidly mounted to the drive-train assembly 7 and projects forwardly thereof. As illustrated, the bracket 30 is substantially parallel to the suspension arm 24. The link 34 is pivotally mounted to the suspension arm 24 at one end thereof at a pivot 38, which is positioned between the pivot $\mathbf{24}_A$ and the rotational axis $\mathbf{16}_A$ of the anti-tip wheel 16. The link 34 is substantially orthogonal to the longitudinal axis of the suspension arm 24, and pivotally mounts to the bracket 30 at pivot 42. The bracket 30 and suspension arm 24 include a plurality of longitudinally spaced-apart apertures 46 for facilitating longitudinal or angular adjustments of the link 34 relative to the bracket 30 and/or the suspension arm 24.

In FIG. 3 the drive-train assembly 7 and linkage arrangement are biased to a predetermined operating or "resting" position by the suspension assembly 9. As illustrated, the suspension assembly 9 comprises a pair of spring strut assemblies 52*a*, 52*b*, each being disposed on opposite sides of the drive-train pivot 8. Furthermore, each spring strut assembly 52*a*, 52*b* is interposed between an upper horizontal frame support $3H_S$ of the main structural frame 3 and the drive-train assembly 7. The first strut 52*a* is pivotally mounted to an L-bracket 56 at a point longitudinally forward of the pivot mount 8. The second strut 52*b* is pivotally mounted to an upper mounting plate 58 for the drive-train assembly 7 at a point longitudinally aft of the pivot 8. When resting, the spring bias forces acting on the drive-train assembly 7 are in equilibrium.

Figure 4:
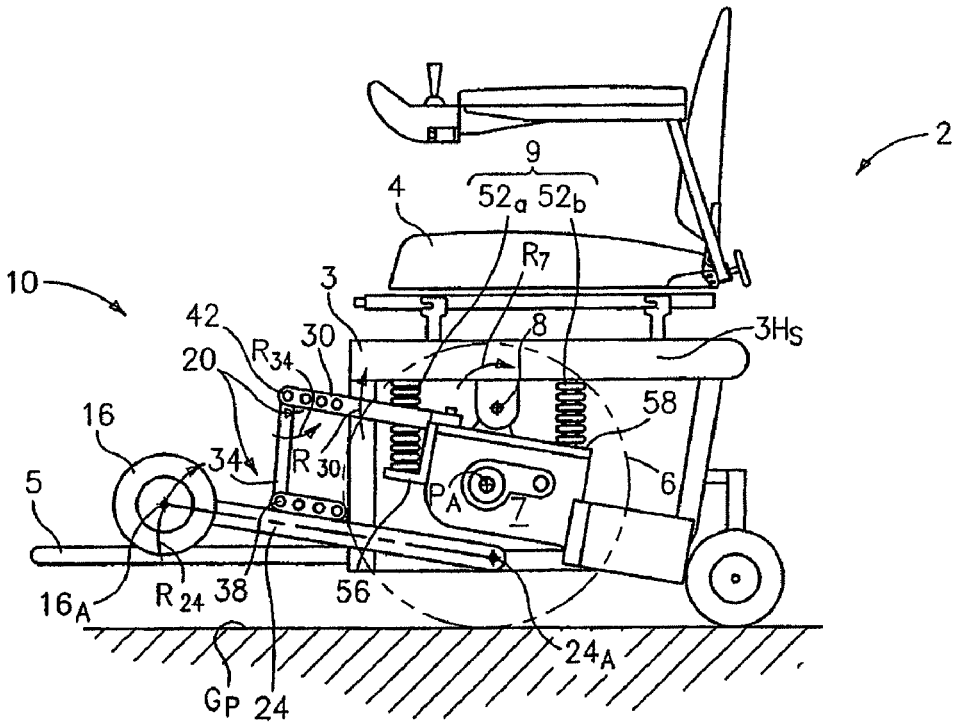
FIG. 4 is a partial side view of the linkage of FIGS. 2 and 3 reacting in response to motor torque or acceleration of the vehicle.

Referring to FIG. 4, in an operational mode requiring increased torque output, such as may be required when accelerating or climbing a curb and/or obstacle, the drive-train assembly 7 rotates in a clockwise direction about pivot 8, indicated by arrow $R_7$. It will be appreciated that the rotational directions described are in relation to a left side view from the perspective of a wheelchair occupant. Rotation of the drive-train assembly 7 will cause the bracket 30 to rotate in the same clockwise direction, see arrow $R_{30}$, and the link 34 to move in a counterclockwise direction, see arrow $R_{34}$, about pivot 42. Clockwise rotation of the bracket 30 affects a substantially upward vertical motion of the link 34. The link 34 rotates the suspension arm 24 in a clockwise direction about pivot $\mathbf{24}_A$, denoted by arrow $R_{24}$, and lifts or raises the anti-tip wheel 16.

In addition to the spatial relationship of the pivot $\mathbf{24}_A$ and the anti-tip wheel 16, the length of the suspension arm 24 also contributes to the enhanced curb-climbing ability. To best appreciate the impact of suspension arm length, consider that a short suspension arm (having a characteristic short radius), tend to traverse a substantially arcuate path in contrast to a linear path of a relatively longer suspension arm. An arcuate path produces components of displacement in both a vertical and forward direction. While the forward component is small relative to the vertical component, it will be appreciated that this component can jam or bind an anti-tip wheel as it lifts vertically. This will more likely occur when the axis of the anti-tip wheel is positioned relatively below the pivot of the suspension arm. Conversely, as a suspension arm is lengthened, the anti-tip wheel traverses a more vertical or substantially linear path. As such, the forward component is substantially eliminated along with the propensity for an anti-tip wheel to jam or bind. To effect the same advantageous geometry, the pivot $\mathbf{24}_A$ of the suspension arm 24 is disposed proximal to the longitudinal center of the main structural frame 3.

Figure 5:
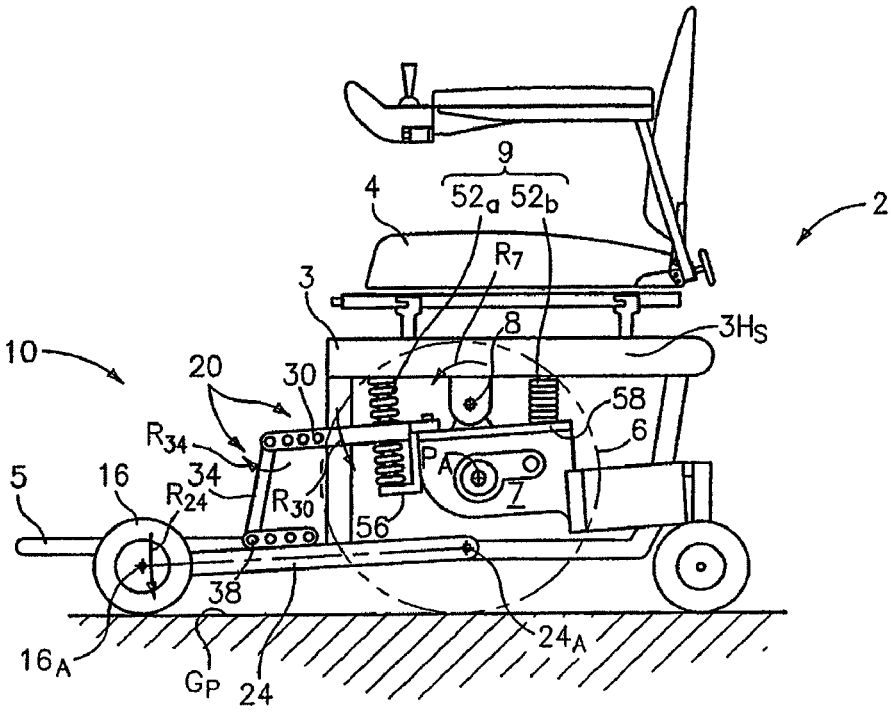
FIG. 5 is a partial side view of the linkage of FIGS. 2 and 3 reacting in response to braking or deceleration of the vehicle.

Referring to FIG. 5, in an operational mode reversing the applied torque, such as will occur during braking or deceleration, the bracket 30, link 34 and suspension arm 24 rotate in directions opposite to those described above with regard to FIG. 4 to urge the anti-tip wheel 16 into contact with the ground plane G. A downward force is produced to counteract the forward pitch or tipping motion of the wheelchair 2 upon deceleration.

The mounting location 38 of the link 34, as illustrated, is at a point on the suspension arm 24 that is closer to the anti-tip wheel 16 than to the pivot $\mathbf{24}_A$. This mounting location functions to augment the structural rigidity of the suspension arm 24 to more effectively stabilize the wheelchair 2. That is, by effecting a stiff structure, structural rigidity of the linkage 20, rapidly arrests and stabilizes the wheelchair about the pitch axis $P_A$. Moving the link 34 closer to the pivot $\mathbf{24}_A$ will, conversely, serve to accentuate the effect of the motion of the drive-train assembly 7; that is, the same linear movement of the pivot 38, when positioned closer to suspension arm pivot $\mathbf{24}_A$ will result in a greater movement of the anti-tip wheels 16, at the end of the arm.

Figure 6:
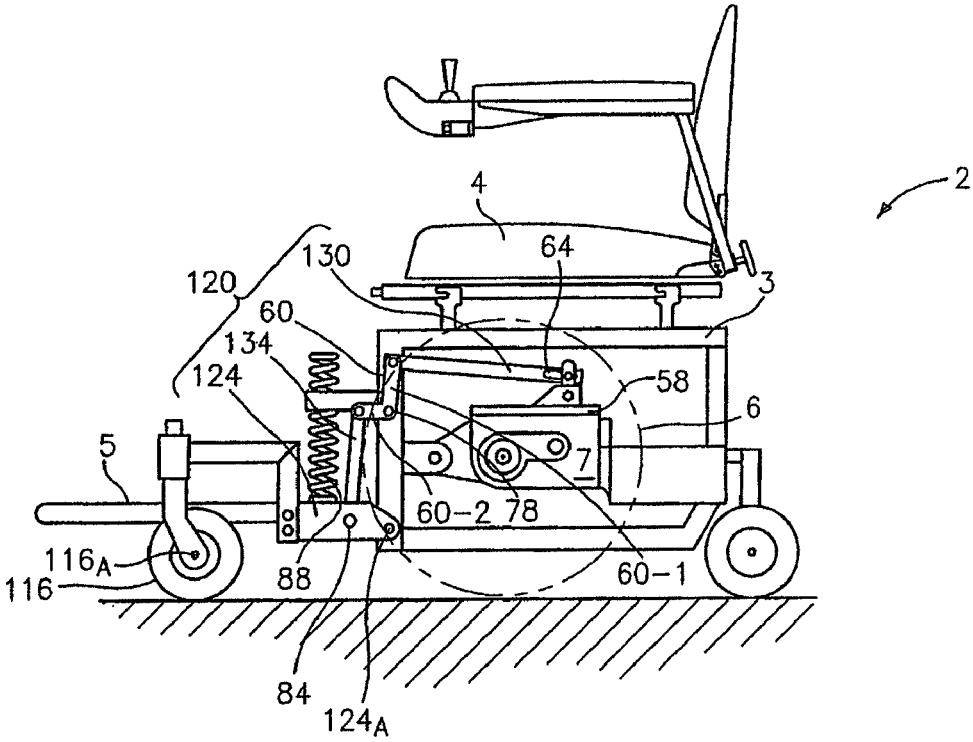
FIG. 6 is a partial side view of an alternate embodiment of a linkage arrangement within a powered vehicle having one of its drive wheels removed to more clearly show the present invention.
Figure 7:
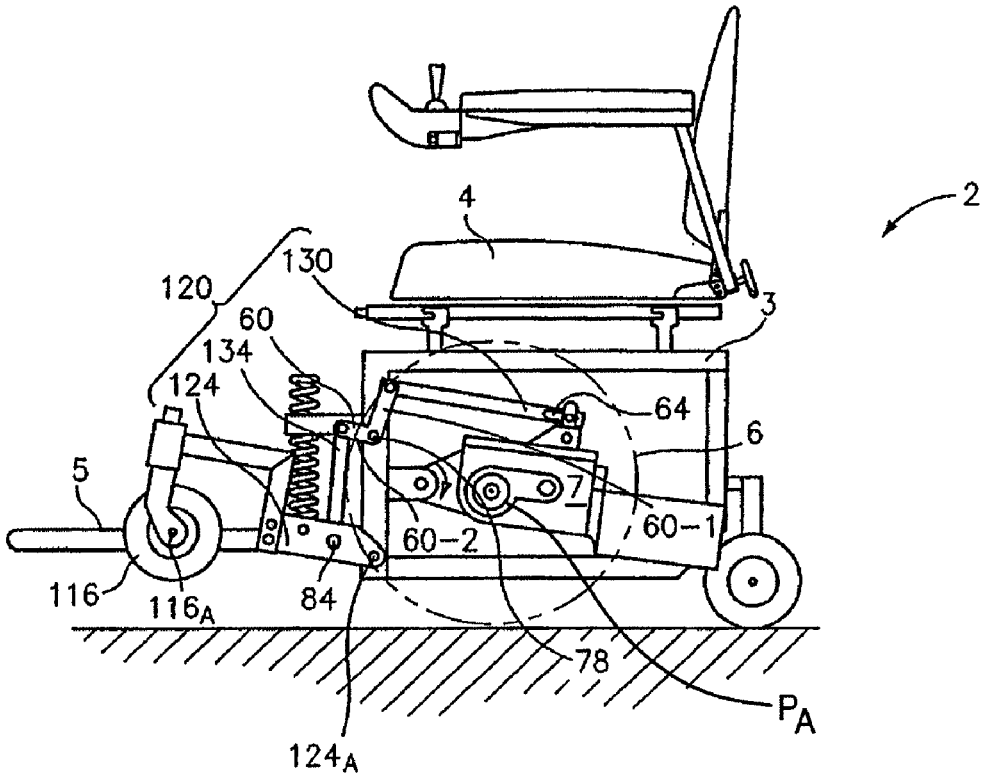
FIG. 7 is a partial side view of the linkage arrangement of FIG. 6 reacting in response to motor torque or acceleration of the vehicle.
Figure 8:
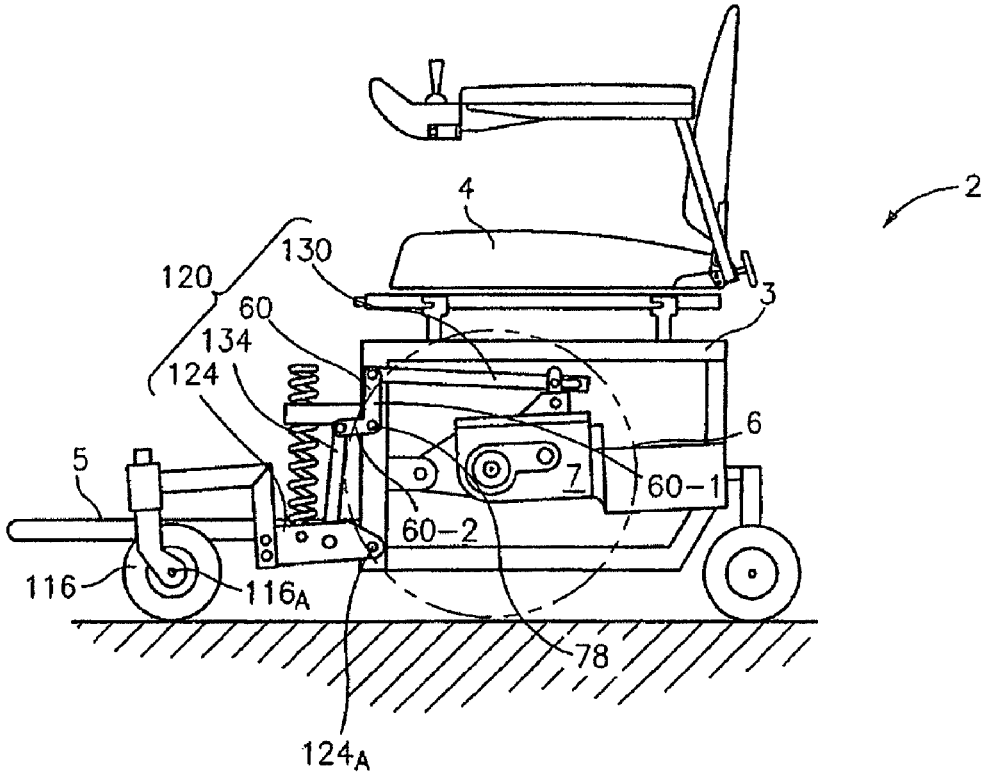
FIG. 8 is a partial side view of the linkage arrangement of FIGS. 6 and 7 reacting in response to braking or deceleration of the vehicle.

FIGS. 6-8 depict and an alternate embodiment 20 of the linkage arrangement adapted for use in powered wheelchairs 2. The linkage arrangement 120 employs a suspension arm 124 having a pivot point $\mathbf{124}_A$, which is spatially positioned at or below the rotational axis $\mathbf{116}_A$ of the anti-tip caster wheel 116. Two links 130, 134 are operatively connected to the drive-train assembly 7 and the suspension arm 124. The first link 130 is fixed to the drive-train assembly 7 while the second link 134 is pivotally mounted to the suspension arm 124, with bell-crank 60 operatively positioned therebetween. The anti-tip wheel 116 as illustrated in this figure is a caster type wheel and, as shown, is normally in contact with the ground $G_p$. A bi-directional spring strut 88 biases the anti-tip system to a resting position. The strut 88 is pivotally mounted to the suspension arm 124, rather than to the drive-train assembly 7 as in FIGS. 2-5.

As seen in FIG. 6, the linkage arrangement 120 includes a bell-crank link 60 for re-directing and/or amplifying input motions originating from the drive-train assembly 7. The bell-crank 60 is pivotally mounted about a pivot 78 on the main structural frame 3. The bell-crank 60 includes first and second crank arms 60-1, 60-2 that, as illustrated, define a right angle therebetween. However, the relative angular orientation of the arms 60-1, 60-2 may vary depending on the positioning of connecting links and the location of the pivot 78. The first and second crank arms 60-1, 60-2 also differ in length. The first crank arm 60-1 is longer than the second arm 60-2. As illustrated, there is a 2:1 length ratio (i.e., first to second length). Also, the first crank arm 60-1 is oriented substantially vertically with respect to the longitudinal axis of the suspension arm 24 and pivotally mounted to the third link 64. The second crank arm 60-2 is substantially horizontal with respect to the longitudinal axis of the suspension arm 24 and is pivotally mounted to the second link 34. Again, these parameters and positions may vary as desired.

The drive-train assembly 7 is pivotably connected to the first link 130 by a substantially vertical projection on the drive-train mounting plate 58. The first link 130 includes an elliptically-shaped aperture or thru-slot 64 to allow the pivot connection to float. Thus, small vertical displacements/perturbations of the anti-tip wheel 116, which may occur, e.g., when riding upon uneven/rough terrain, do not significantly back-drive the drive-train assembly 7.

FIGS. 7 and 8 are analogous to FIGS. 4 and 5, respectively, wherein the linkage kinematics are illustrated. One difference between the linkage arrangement 120 of FIGS. 7 and 8 relates to the amplification of displacement gained from the bell-crank 60. The bell crank 60 serves to redirect horizontal linear motion of the drive-train 7 to create a vertical motion of the anti-tip wheel 116. Further, the bell-crank 60 increases the mechanical advantage for a given applied torque. This enables a relatively close positioning of the pivot connection 84 to the pivot $\mathbf{124}_A$, while still resulting in a significant motion by the suspension arm 124. As shown in FIG. 7, the anti-tip caster wheel 116 is able to traverse a large vertical distance. That is, the vertical displacement of the anti-tip caster wheel 116 is magnified by the bell crank 60 and the proximal spacing of the pivot connection 84 to the axis $\mathbf{124}_A$.

It will be appreciated that, in view of the spatial positioning of the pivot connection 84 and length ratio of the bell-crank arms 60-1, 60-2, various levels of displacement and/or moment loads may be achieved or applied by the linkage arrangement 120 within a relatively confined design envelope.

Furthermore, additional leverage is provided to the anti-tip caster wheel 116 so as to stabilize the wheelchair about its pitch axis $P_A$. The castor 116 rides normally on the ground $G_p$. Upon deceleration, the drive-train assembly 7 lifts and creates a force, through the linkage 120, that forces the anti-tip wheel 116 into the ground $G_p$ and restricts the ability of the suspension 88 to compress. This arrangement limits pitch of the wheelchair. Further, in the normal rest position, a force on the foot plate 5 (such as by a person standing) will not cause significant rotation of the wheelchair about the pitch axis $P_A$.

Figure 9:
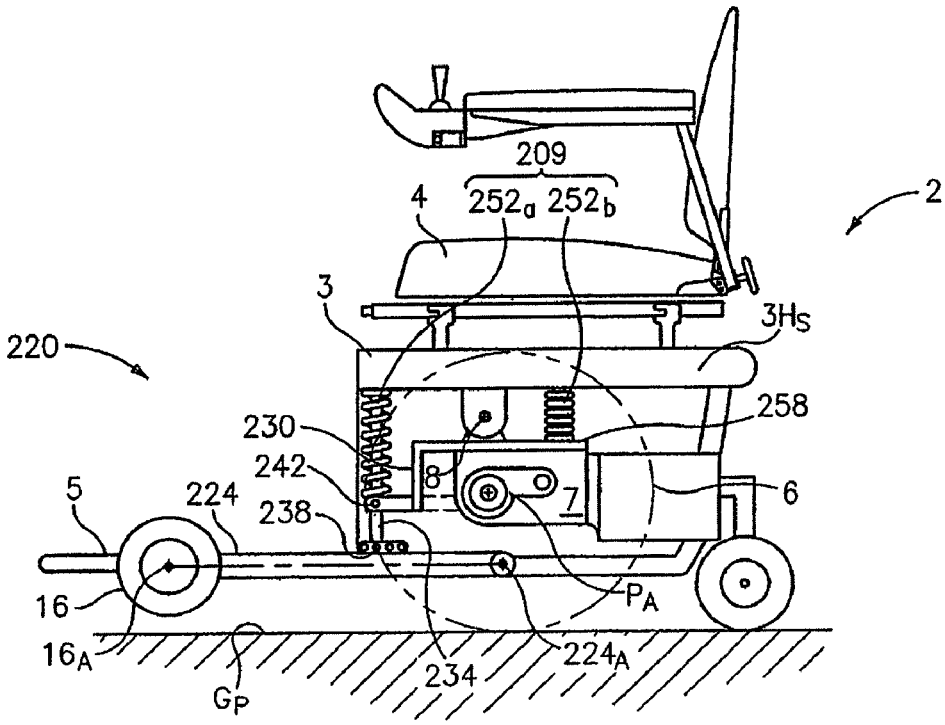
FIG. 9 is a partial side view of a further embodiment of a linkage arrangement within a powered vehicle having one of its drive-wheels removed to more clearly show the present invention.

In FIG. 9, the wheelchair 2 includes a further embodiment of an anti-tip system linkage 220, which is supported on a main structural frame 3. A drive-train assembly 7 is pivotally mounted to the frame 3 about a pivot 8 to effect relative rotation therebetween in response to positive or negative acceleration or torque. A suspension assembly 209 is provided for biasing the drive-train assembly 7 and the anti-tip system to a predetermined operating position.

A suspension arm 224 is pivotally mounted to the frame 3 at pivot $\mathbf{224}_A$. At the opposite end of the suspension arm 224 is mounted on anti-tip wheel 16, which is rotatable about a rotational axis $\mathbf{16}_A$. Again, it is preferred that the position of the rotational axis $\mathbf{16}_A$ lie substantially at or above the vertical position of the pivot $\mathbf{224}_A$. As illustrated, the pivot $\mathbf{224}_A$ is disposed inboard of the front of the frame 3 and is positioned proximal to the drive wheel axis, or pitch axis $P_A$, and substantially vertically below the drive-train assembly pivot 8.

A mounting extension 230 projects from the mounting plate 258 for the drive-train assembly 7. A link 234 is pivotally mounted 238 to the suspension arm 224 between the pivot $\mathbf{224}_A$ and the rotational axis $\mathbf{16}_A$ of the anti-tip wheel 16. Furthermore, the link 234 is substantially orthogonal to the longitudinal axis of the suspension arm 224, and mounts to the extension 230 at a pivot 242. As illustrated, the anti-tip wheel has a fixed axis, rather than being a caster, as is shown in FIGS. 6-8. However, caster type anti-tip wheels may be used on this embodiment, as well as any of embodiments shown. The anti-tip wheel may be positioned as close to the ground as desired. Casters will normally ride on the ground.

As illustrated, the suspension assembly 209 comprises a pair of suspension springs $\mathbf{252}_a$, $\mathbf{252}_b$, disposed on opposite sides of the drive-train pivot 8. Each of the suspension springs $\mathbf{252}_a$, $\mathbf{252}_b$ is interposed between an upper horizontal frame support $3H_S$ of the main structural frame 3 and the drive-train assembly 7. The forward spring $\mathbf{252}_a$ is mounted adjacent to or directly above the pivot 242 for link 234. The aft suspension spring $\mathbf{252}_b$ (considered to be optional) is mounted to an upper mounting plate 258 for the drive-train assembly 7 at a point longitudinally aft of the mounting pivot 8. When resting, the spring bias of the assembly 209 acting on the drive-train assembly 7 is in equilibrium.

Figure 10:
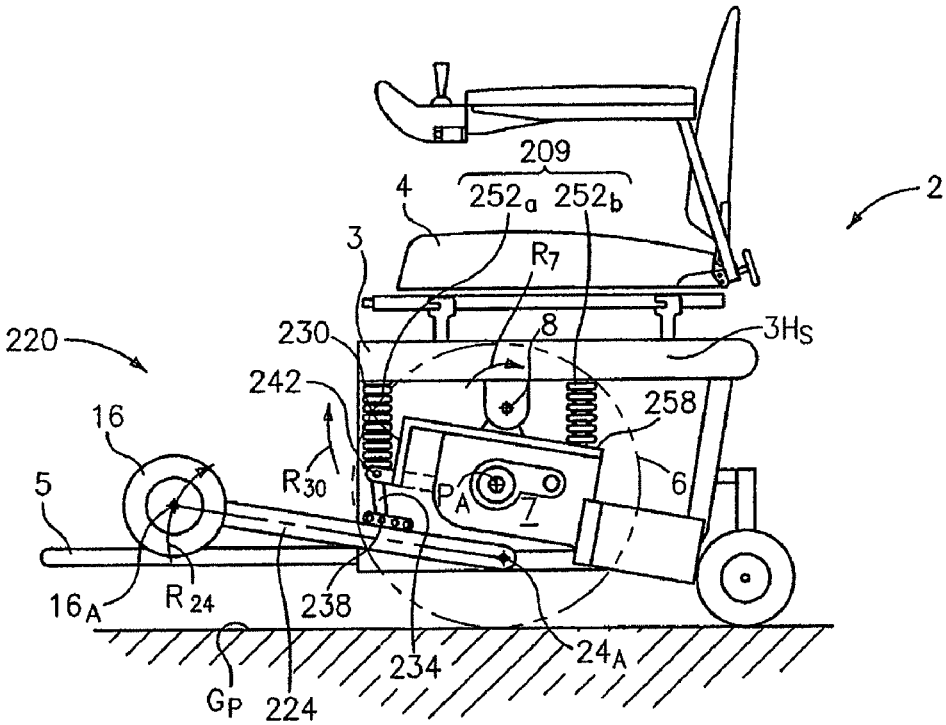
FIG. 10 is a partial side view of the linkage arrangement of FIG. 9 reacting in response to motor torque or acceleration of the vehicle.
Figure 11:
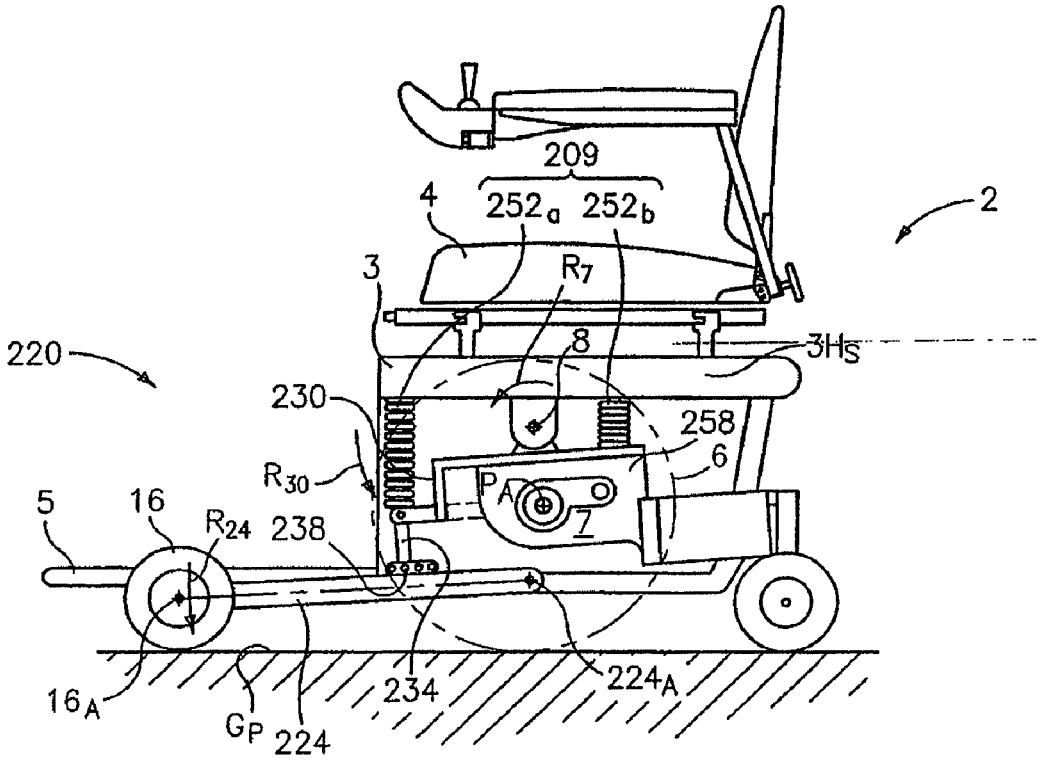
FIG. 11 is a partial side view of the linkage arrangement of FIGS. 9 and 10 reacting in response to braking or deceleration of the vehicle.

Referring to FIGS. 10 and 11, in an operational mode the applied torque, such as will occur during acceleration or curb/obstacle climbing (FIG. 10) or during braking or deceleration (FIG. 11), the link 234 serves to move the suspension arm 224, which rotates to urge the anti-tip wheel 16 upward or into contact with the ground plane G. For the purposes of conciseness, the kinematics of the linkage arrangement will not be again described in detail.

The substantial co-axial alignment of the pivots 238 and 242 of the linkage 234 and the forward suspension spring $\mathbf{252}_a$ creates a direct load path for augmenting pitch stabilization. That is, by tying the forward suspension spring $\mathbf{252}_a$ directly to the link 234, loads tending to force the anti-tip wheel 16 and suspension arm 224 upwardly will be reacted to immediately by the suspension assembly 209. A similar direct reaction is created with the counter clockwise rotation of the motor due to deceleration or braking (FIG. 11). Further, the linkage assembly can be positioned inside the confines of the frame 3.

While the linkage arrangements above have been described in terms of various embodiments that exemplify the anticipated use and application of the invention, other embodiments are contemplated and also fall within the scope and spirit of the invention. For example, while the linkage arrangements have been illustrated and described in terms of a forward anti-tip system, the linkage arrangements are equally applicable to a rearward or aft stabilization of a powered wheelchair.

Furthermore, it is contemplated that the anti-tip wheel may be either out of ground contact or in contact with the ground, whether employing a long suspension arm (such as that shown in FIGS. 2-5), a relatively shorter suspension arm (FIGS. 6-8), or when including a bell crank (FIGS. 6-8). Also, the anti-tip wheel may be in or out of ground contact when disposed in combination with any of the linkage arrangements.

The linkage arrangements as illustrated may include apertures for enabling adjustment. Other adjustment devices are also contemplated. For example, a longitudinal slot may be employed in the bracket or link and a sliding pivot mount may be engaged within the slot.

Figure 12:
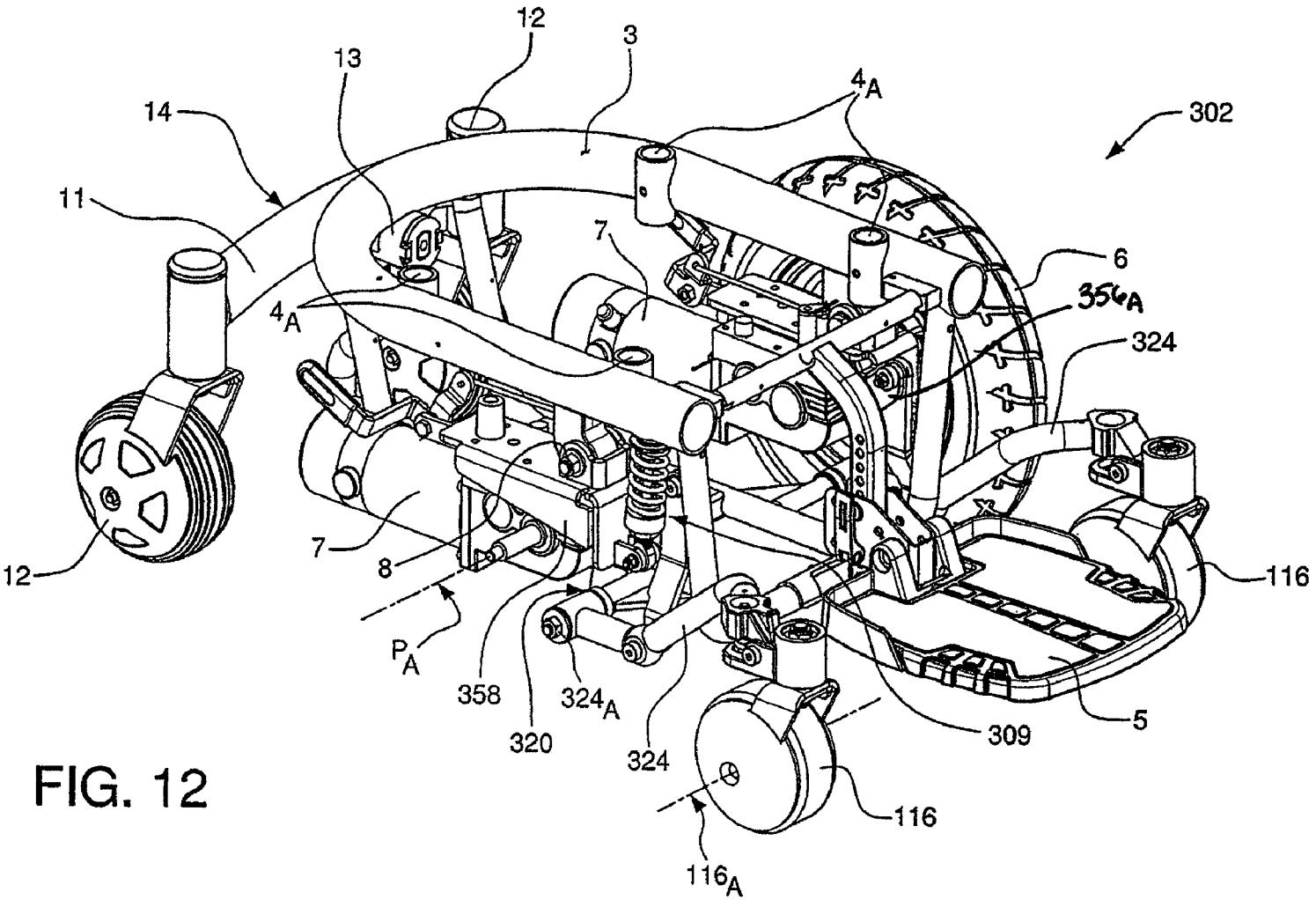
FIG. 12 is a perspective view of a further embodiment of a linkage arrangement within a powered vehicle having one of its drive wheels removed to more clearly show the present invention.
Figure 13:
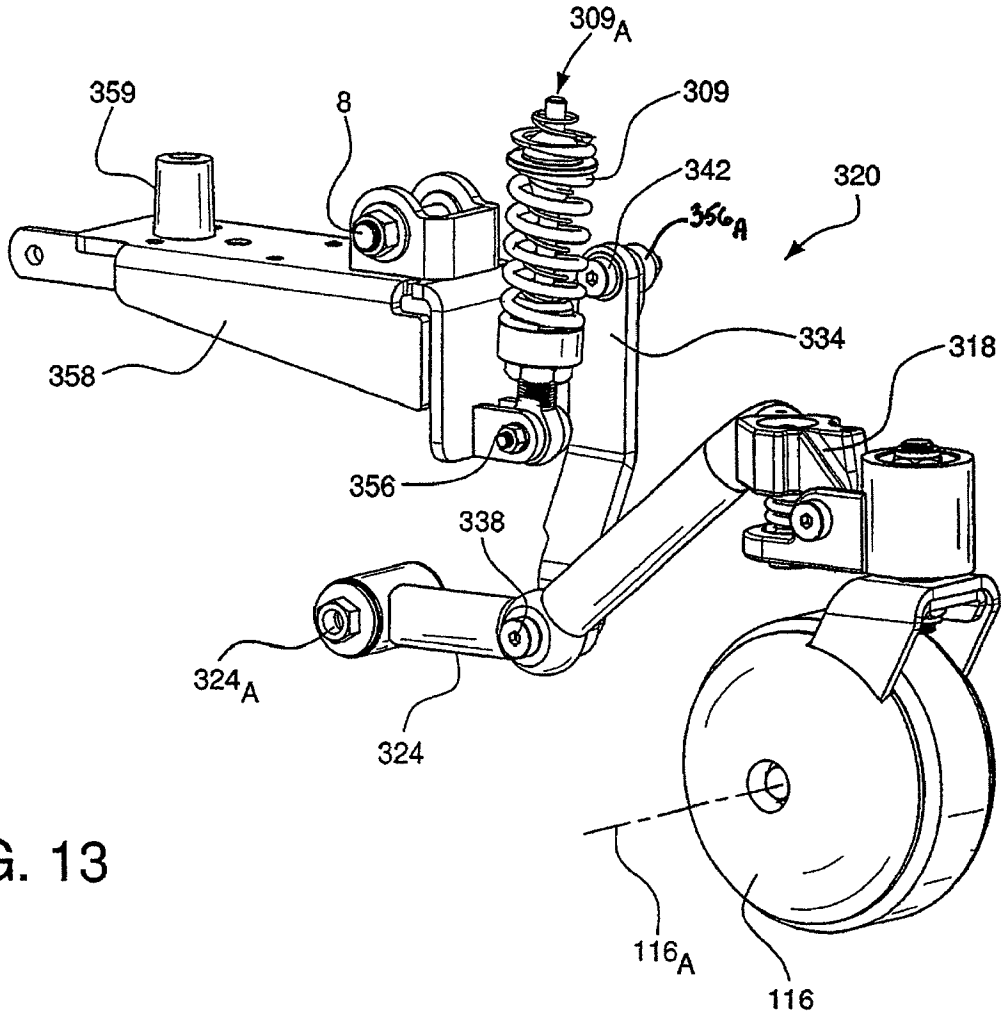
FIG. 13 is an enlarged view of the linkage arrangement of the embodiment shown in FIG. 11.

In FIGS. 12-13, there is illustrated a further vehicle structure which incorporates the features of the linkage arrangement and anti-tip systems of the present invention. The wheelchair vehicle in these figures is generally referred to by the numeral 302 and includes a main structural frame 3, which supports a seat (not shown) that is mounted on seat post sockets $\mathbf{4}_A$. A footrest 5 is positioned on a forward portion of the frame 3 and a drive-train assembly 7 is mounted on the frame 3 at pivot 8. In the perspective view of FIG. 12, one drive wheel has been removed for purposes of illustrating the linkage 320. The far side drive wheel 6 has been illustrated in this FIG. 12. Attached to the rear of the frame 3 is the rear suspension 14 that, in this embodiment, includes a rocker arm 11 pivotally mounted to the frame at pivot 13 and including caster wheels 12 at each projected end of the rocker arm 11.

In FIG. 13, the linkage arrangement 320 is specifically illustrated with the remaining portions of the vehicle being removed. The linkage 320 includes a first link 334 attached at its upper end at pivot 342 to a bracket $\mathbf{356}_A$ extending from drive-train mounting plate 358. The opposite end of the first link 334 is connected at a lower pivot 338 to the suspension arm 324. The suspension arm 324 is secured to the frame (FIG. 12) at suspension pivot $\mathbf{324}_A$. At the projected end of the suspension arm 324 is provided a caster assembly 116, serving as the anti-tip wheel for the suspension. The anti-tip wheel 116 includes an anti-tip wheel axel $\mathbf{116}_A$ and also includes a flexible mount 318 that permits limited movement of the anti-tip wheel back towards the linkage 320 when it engages an obstacle. A stop 359 is also provided on the mounting plate 358 to limit upward movement of the drive-train assembly about pivot 8.

In addition to the linkage 320, a suspension assembly 309 is provided. The suspension is pivotally mounted to a bracket 356 on the mounting plate 358. The upper end of the suspension $\mathbf{309}_A$ engages the upper portion of the frame 3. From this arrangement, it can be seen that rotation of the mounting plate 358 about the pivot 8 will cause a corresponding movement of the suspension arm 324 by means of the link 334. Movement of the link 334, which is transferred to the suspension arm 324, causes a pivoting motion of the suspension atm 324 about its pivot $\mathbf{324}_A$. The pivoting motion of the suspension arm 324 causes a corresponding motion to the anti-tip wheel 116.

Figure 14:
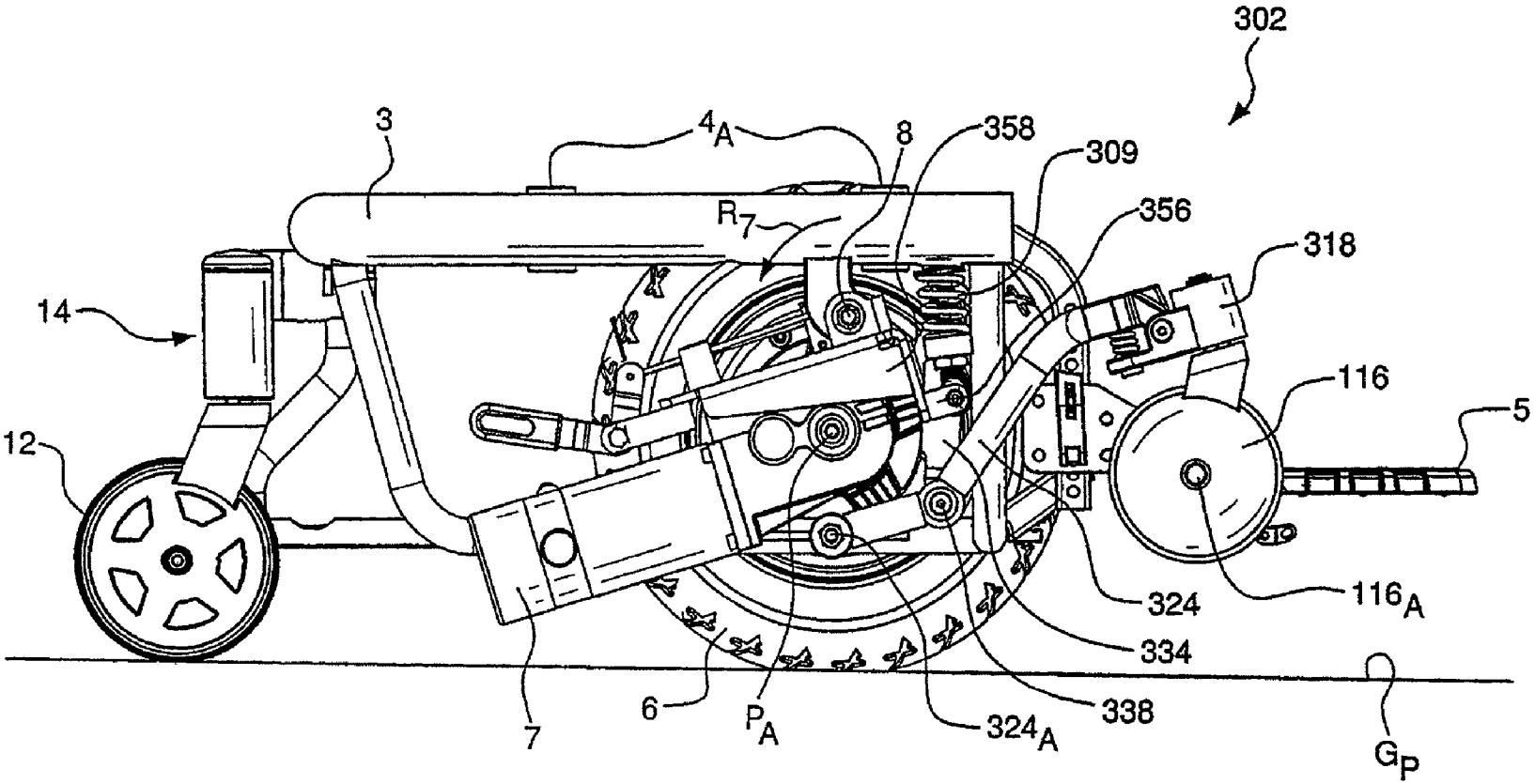
FIG. 14 is a partial side view of the linkage arrangement of FIGS. 12 and 13 reacting in response to motor torque or acceleration of the vehicle.

In FIG. 14, there is shown the operational mode of the vehicle 302 where an increased torque output is provided, such as may be required when accelerating or climbing a curb and/or obstacle. The drive-train assembly 7 rotates in a counter-clockwise direction (as seen in this FIG. 14) about pivot 8 as indicated by arrow $R_7$. Rotation of the drive-train assembly 7 will cause the mounting plate 358 to also rotate, lifting the link 334 upwardly. Due to the connection between the link 334 and the suspension arm 324, the suspension arm also pivots in a counter clockwise direction about the suspension arm pivot $\mathbf{324}_A$. The counter clockwise rotation (again as seen in FIG. 14) of the suspension arm 324 causes the anti-tip wheel 116 to lift off of the ground plane G. In addition to movement of the linkage in response to the motion of the drive-train assembly 7, the suspension 309 compresses due to the upward movement of the bracket 356 and the fixed positioning of the frame 3. Compression of the spring creates a restoration force for the linkage, returning the suspension arm 324 and anti-tip wheel 116 to its normal position upon removal of the torque of the drive-train 7. As will be understood by reference to the figures above, a deceleration or braking torque will cause a corresponding opposite reaction by the assembly about the pivot 8 thereby forcing the anti-tip wheel into the ground plane G.

Figure 15:
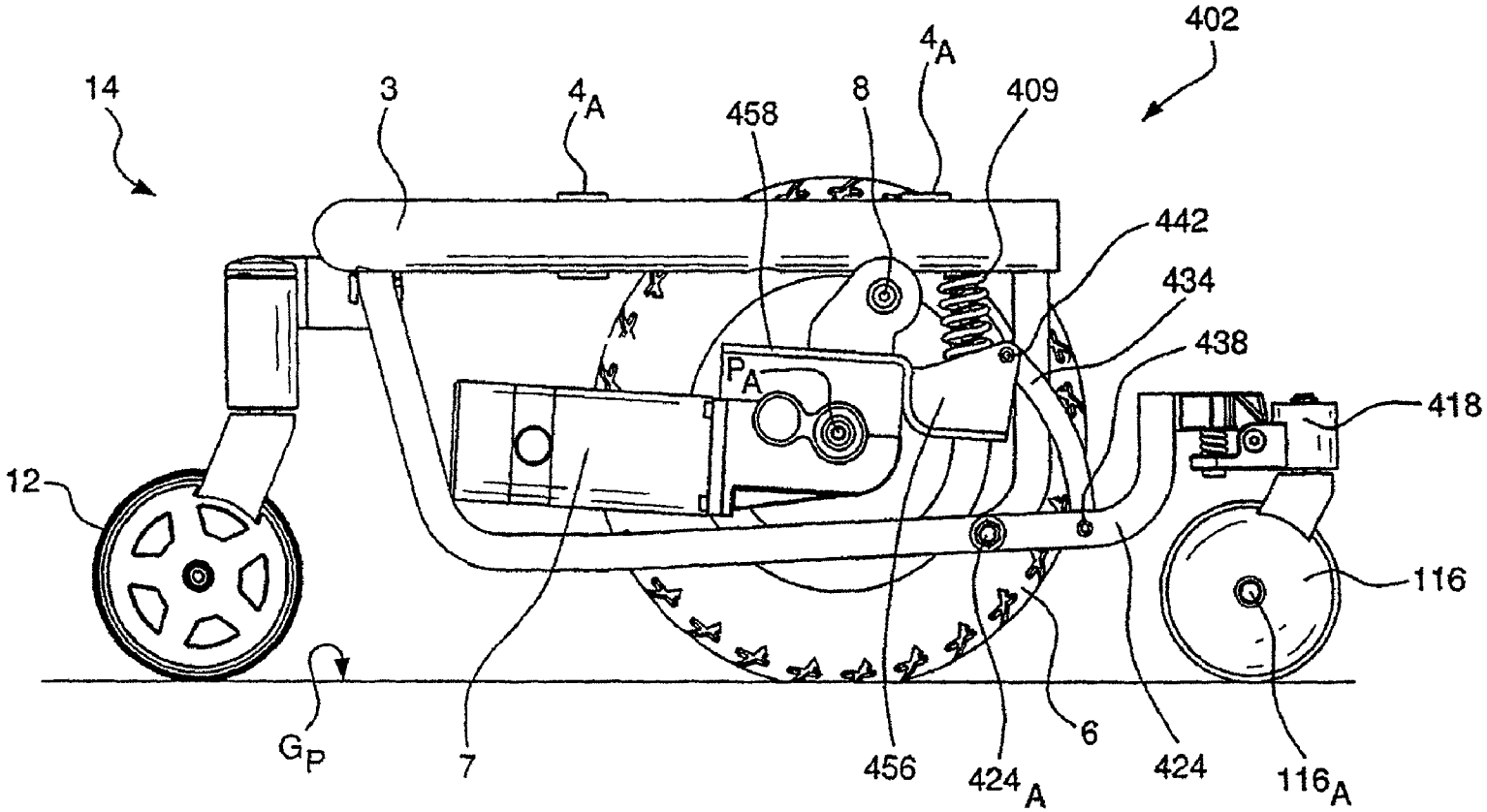
FIG. 15 is a partial side view of a further embodiment of a linkage arrangement within a powered vehicle having one of its drive wheels removed to more clearly show the present invention.
Figure 16:
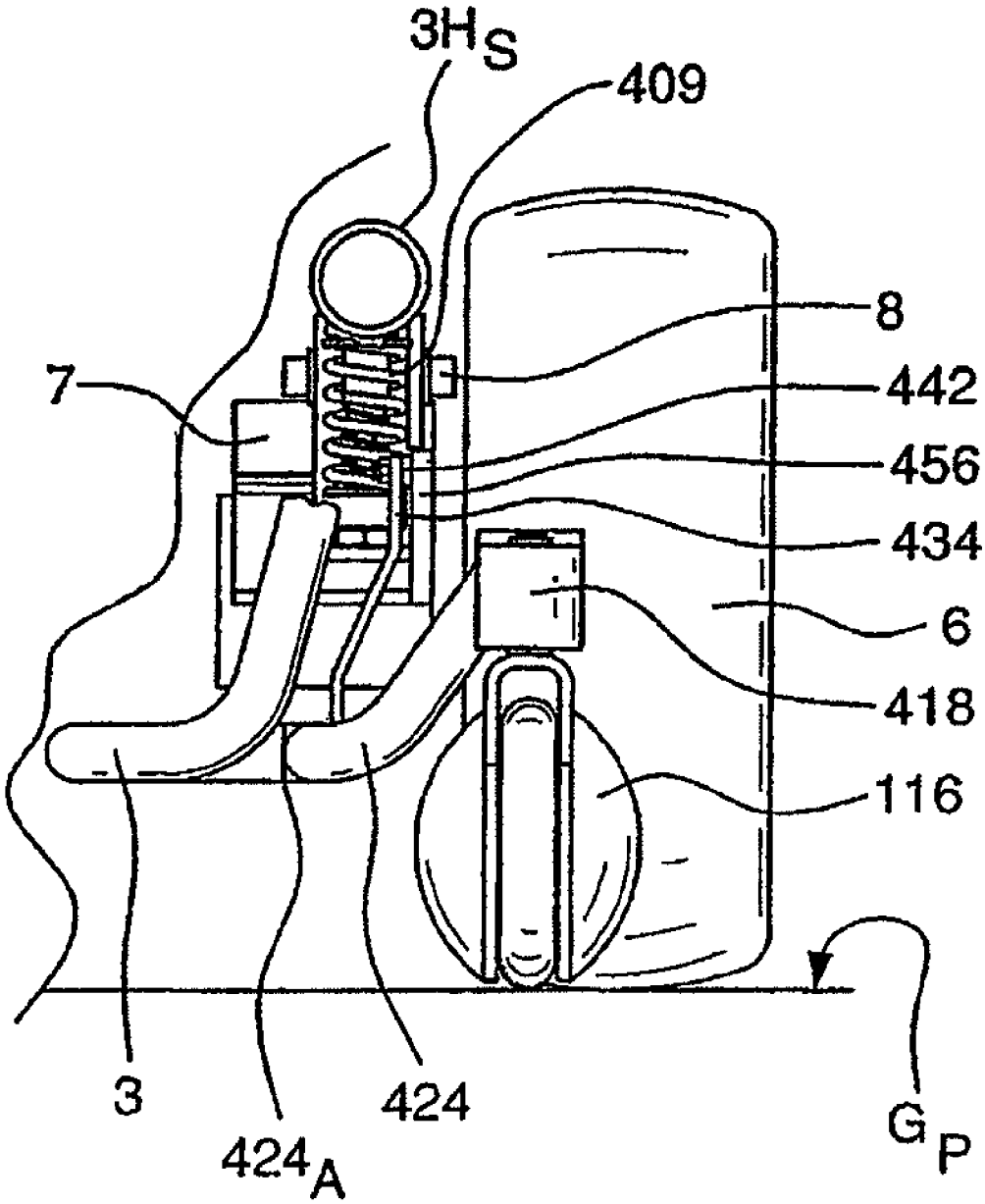
FIG. 16 is a partial front elevation of the linkage arrangement of FIG. 15 with portions of the vehicle frame being removed to more clearly show the features of the present invention.
Figure 17:
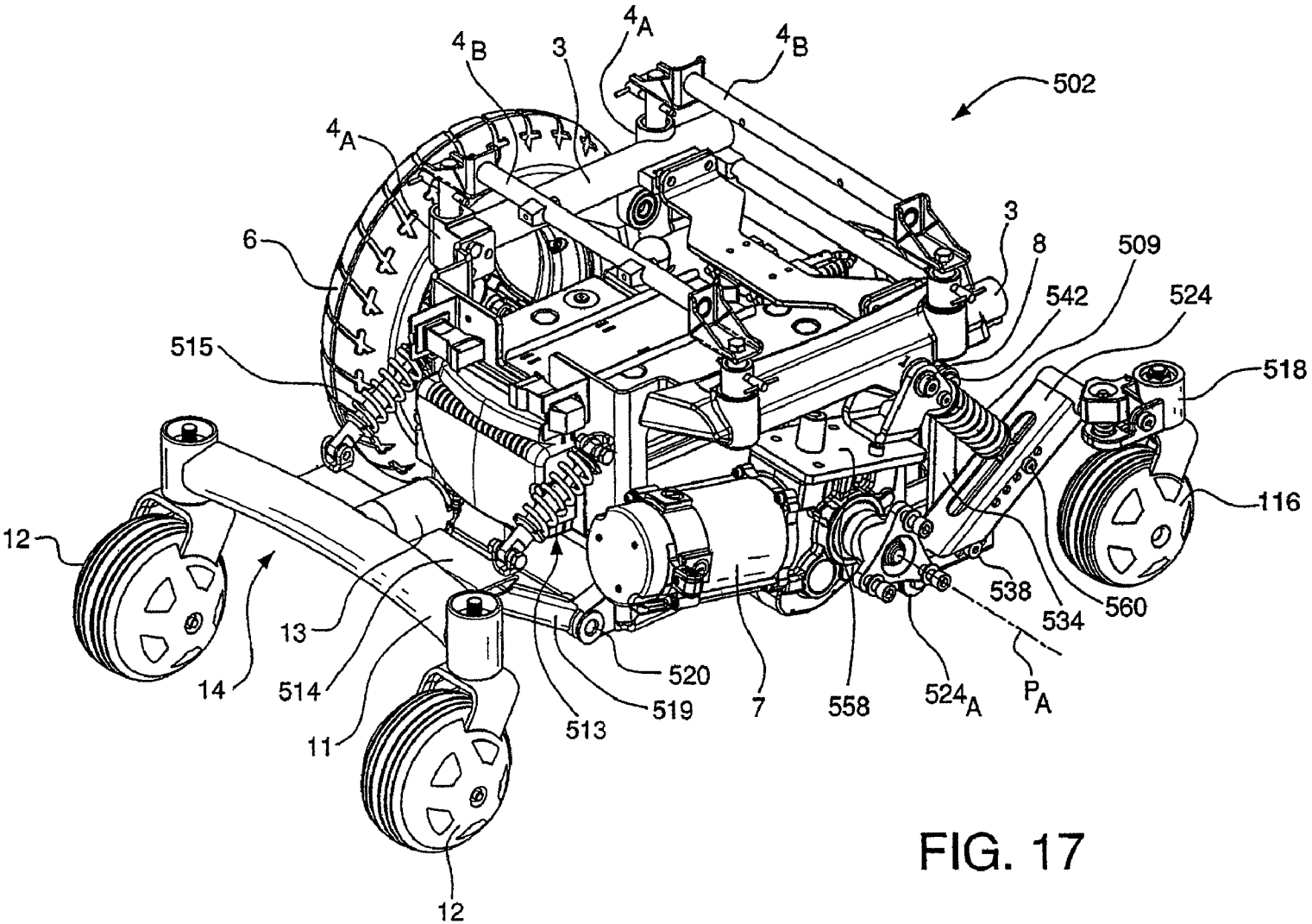
FIG. 17 is a partial perspective view of a still further linkage arrangement within a powered vehicle having the near drive wheel removed and having the opposite side drive train assembly omitted to more clearly show the structure of the present invention within the wheelchair assembly.

There is shown in FIGS. 15 and 16 a further embodiment of the linkage arrangement as contemplated by the present invention. In this variation, the link connecting the drive-train and the suspension arm has been adapted to accommodate various modifications in the frame and other structures. In FIG. 15, the vehicle 402 includes a frame 3 supporting a drive-train assembly 7 about a pivot 8, with the drive-train assembly 7 driving a drive wheel 6. One drive wheel 6 is illustrated in FIG. 15, with the relatively closer drive wheel removed for clarity. Further, the battery structures, which are typically centrally mounted within the frame 3, have also been removed for clarity. The frame 3 also supports a seat (not shown). Mounting sockets $\mathbf{4}_A$ are provided for purposes of mounting a seat, although other mounting arrangements may be provided as desired. A rear suspension 14 is also illustrated.

Front anti-tip wheels 116 project forwardly of the frame 3 and are mounted on a suspension arm 424 by means of resilient mount 418. The suspension arm 424 is pivotally mounted to the frame 3 at pivot $\mathbf{424}_A$. A link 434 is pivotally connected to the suspension arm 424 at pivot 438. The upper end of the link 434 is pivotally connected 442 to a bracket 456, which is formed as part of the drive-train mounting plate 458. The mounting plate 458 is pivotally connected to the frame at pivot 8 and supports the drive-train assembly 7. A suspension 409 extends between the bracket 456 and the upper portion of the frame 3 of the vehicle 402.

As can be seen in FIG. 15, the link 434 includes a forwardly projecting curvature. Thus, the pivot 442 between one end of the link 434 and the bracket 456 is relatively rearward of the pivot 438 that connects the link 434 to the suspension arm 424. As seen in FIG. 16, the link 434 has an inward step towards the central portion of the vehicle 402. Thus, the pivot 442 between the link 434 and the bracket 456 is closer to the drive wheel 6 than is the connection between the link 434 and the suspension arm 424. Further, the suspension arm 424 includes an outwardly projecting portion such that the caster 116 and its mount 418 extend relatively outward from the frame 3, as compared to its pivot $\mathbf{424}_A$. In this FIG. 16, the lower portion of the frame 3 is partially broken away so as to expose the suspension 409 as it extends between the bracket 456 and the upper frame portion $3H_S$. A further feature of these linkage connections may include the positioning of the pivot 438 for linkage 434 within the suspension arm 424. Thus, a slot or groove may be formed in the suspension arm and the end of the link 434 inserted therein. These structures serve to position the linkage and structures at a desired position within the confines of the frame and other structures of the vehicle 402. Further modifications and alterations may be provided so as to permit the linkage to fit within the vehicle structures.

In FIGS. 17-20, there is shown a further variation of a vehicle having an anti-tip suspension as contemplated by the present invention. The wheelchair 502 includes a structural frame 3 that supports a seat (not shown). Seat mounting sockets $\mathbf{4}_A$ are provided on the frame 3, and seat mounting bars $\mathbf{4}_B$ are provided for attachment of the seat thereto. The drive-train assembly 7 is pivotally mounted to the frame 3 at pivot 8. An opposing drive-train assembly 7 (including the anti-tip wheel) has been omitted from the illustration for purposes of clarity. A drive wheel 6 is shown on the far side of the vehicle frame with the near side drive wheel having been removed for illustration purposes. The axis of rotation of the drive wheel 6 constitutes the pitch axis $P_A$ for the vehicle 502. A rear suspension 14 is provided with a rocker arm 11 and caster wheels 12. A further suspension assembly 513 is provided for fixing the rocker arm 11 to the frame 3. The suspension assembly 513 includes dual dampening mechanisms 515 having a spring and a central piston. The dampening mechanisms 515 are attached at one end to the frame 3 and at the opposite end to a bar 514. The bar 514 is pivotally mounted to the frame at pivots 520 by means of arms 519.

Figure 18:
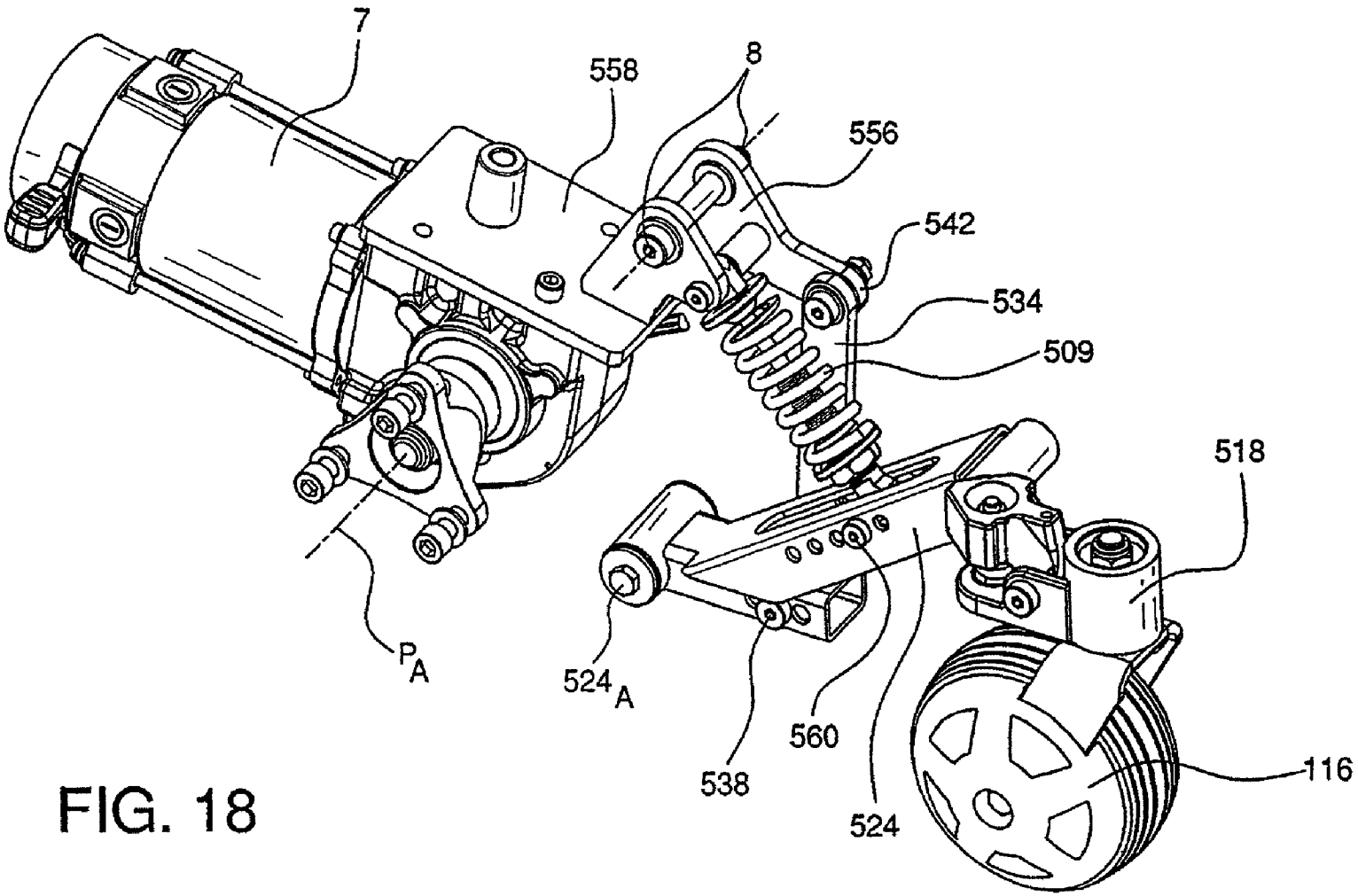
FIG. 18 is a perspective view of the linkage arrangement of the embodiment shown in FIG. 17.

FIG. 18 shows an enlarged view of the linkage arrangement of the present embodiment. The drive-train assembly 7 is attached to the mounting plate 558 having a bracket 556 that connects to the drive-train pivot 8. The bracket 556 further connects to the link 534 at pivot 542. Suspension 509 is also connected to the bracket 556 at one end. The link 534 extends downwardly to a pivot 538 on the suspension arm 524. Suspension 509 also attaches to the suspension 524 at pivot 560. A series of mounting holes are provided on the suspension arm 524 for the attachment of the suspension 509 at a variety of positions. Mounting holes are also provided for attachment of the link 534 to the pivot arm 524, permitting re-positioning of the pivot 538. At the one end of the suspension arm 524 is pivot $\mathbf{524}_A$, which attaches to the frame (not shown in FIG.

18). The opposite end of the suspension arm 524 supports the anti-tip wheel 116. In this embodiment, the anti-tip wheel 116 shown is a caster type wheel having a caster support 518 including a resilient mounting to permit limited deflection of the caster upon engagement of an obstacle.

Figure 19:
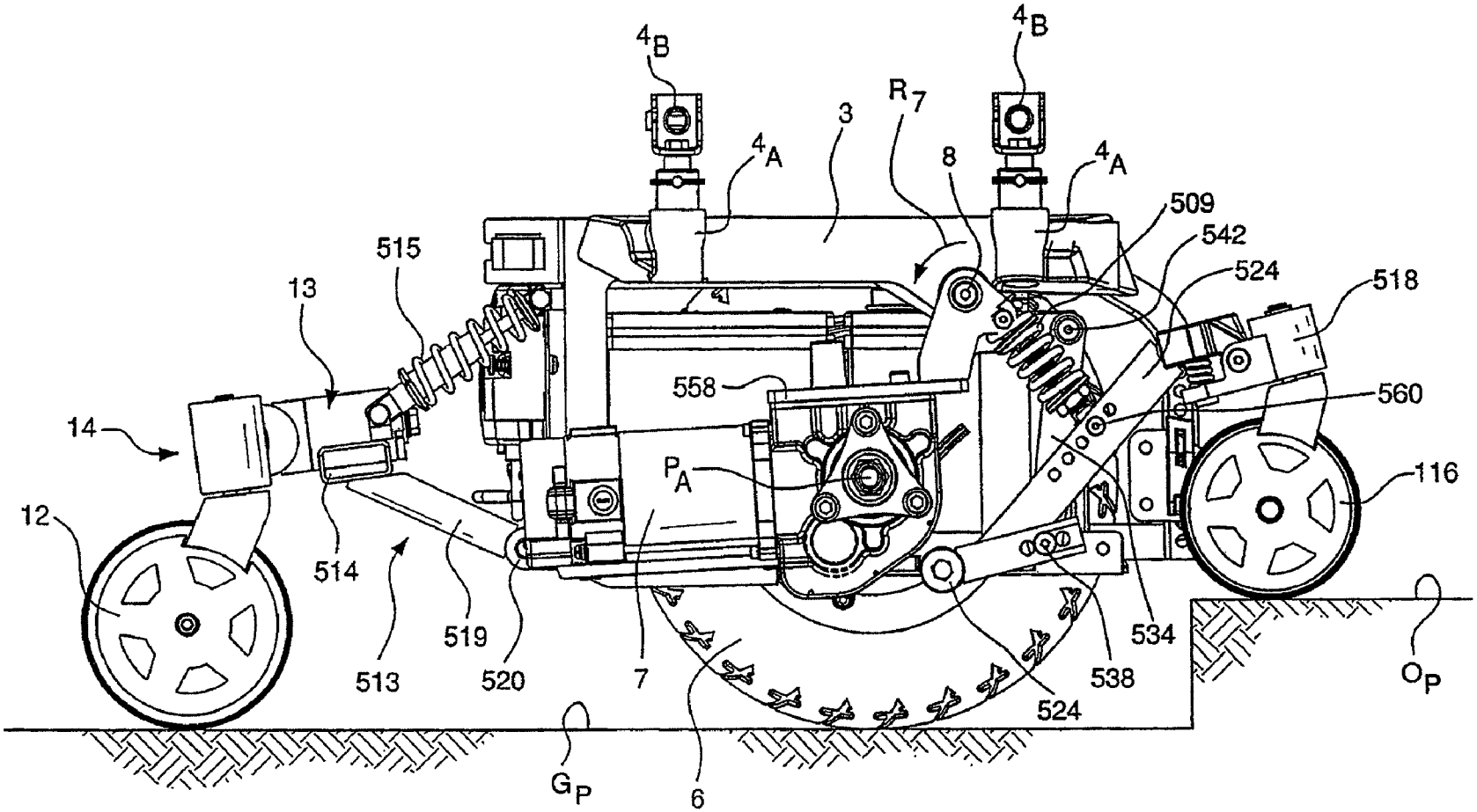
FIG. 19 is a partial side view of the linkage arrangement of FIGS. 17 and 18 reacting in response to motor torque or acceleration of the vehicle.

As seen in FIG. 19, a torque generated by the drive-train 7 for purposes of climbing a curve or obstacle causes a rotation of the drive-train 7 about pivot 8 as illustrated by arrow $R_7$. From the side view illustrated in FIG. 19, it can be seen that the drive-train assembly 7 moves counter-clockwise about the pivot 8, causing the link 534 to move upwardly along with the bracket (556). The link 534 thus lifts the suspension arm 524, causing a counter-clockwise rotation about its pivot $\mathbf{524}_A$. The pivoting rotation of the suspension arm 524 causes the anti-tip wheel 116 to lift off the ground plane $G_p$ and, as illustrated in FIG. 19, to step up over the obstacle.

During the action illustrated in FIG. 19, the counter-clockwise rotation of the drive-train 7 will cause a slight compression of the suspension 509 due to the differences in the location of attachment of the suspension arm 524 and the position of the link 534. When the torque subsides, the suspension will normally cause the drive-train 7 to move back into its normal rest position, and lower the anti-tip wheel 116. The force of the suspension on the obstacle surface $O_p$ will help lift the frame 3 and the drive wheel 6 over the obstacle.

It is further contemplated that the suspension members 515 will also compress upon any counter-clockwise rotation of the frame 3 about the pitch axis $P_A$. The motion of the frame 3 back on the suspension 515 will also cause a pivoting motion of the arms 519.

Figure 20:
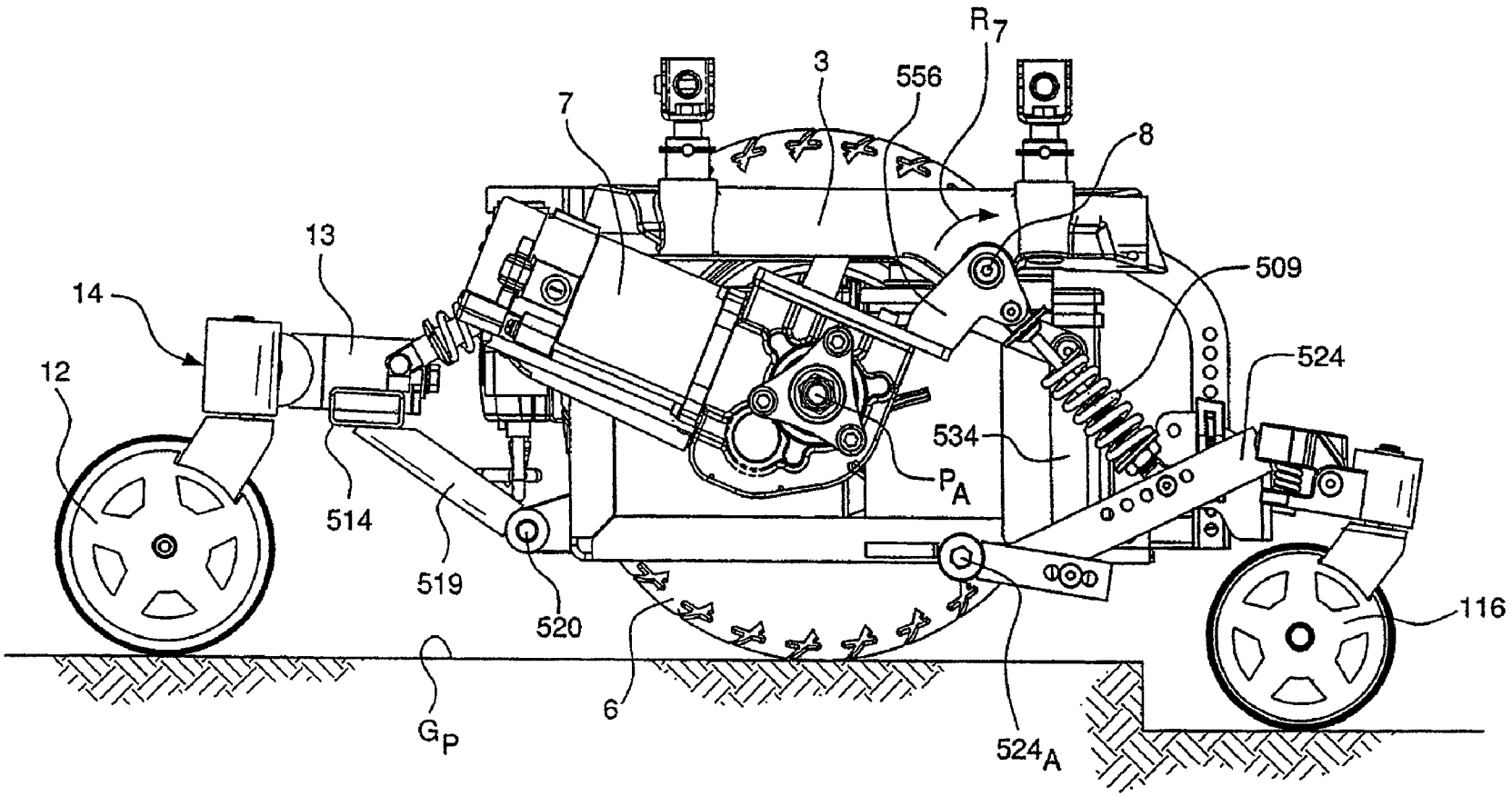
FIG. 20 is a partial side view of the linkage arrangement of FIGS. 17-19 reacting in response to breaking or deceleration of the vehicle.

There is illustrated in FIG. 20 a further reaction of the vehicle in response to deceleration and/or the response of the linkage arrangement to variations in the ground plane. In this figure, the anti-tip wheel 116 has moved over a curb and is in contact with a plane that is relatively below the ground plane $G_p$ on which the drive wheel sits and the rear casters 12 rest. The suspension 509 extends to permit the anti-tip wheel 116 to engage the lower surface. Further, the linkage 534 adapts to this motion. Assuming a deceleration force or breaking torque, the drive-train assembly 7 rotates clockwise (in this FIG. 20) about the pivot 8 as illustrated by arrow $R_7$. The connection between the bracket 556 and the link 534 causes the suspension arm 524 to move downwardly to help engage the lower plane. If the caster 116 was on level ground with the drive wheel 6 and rear caster 12, the drive-train 7 will force the front casters 116 into the ground, providing a force that resists the pitch of the vehicle about the pitch axis $P_a$. A similar force would be provided by the suspension 509 in the normal rest position should the occupant stand on the footplate (not shown). Thus, pitch of the vehicle would not occur if a force were applied to the footplate on one side of the pitch axis $P_a$. The spring force and the linkage arrangement between the drive-train 7 and the anti-tip wheel 116 adds further support.

Figure 21:
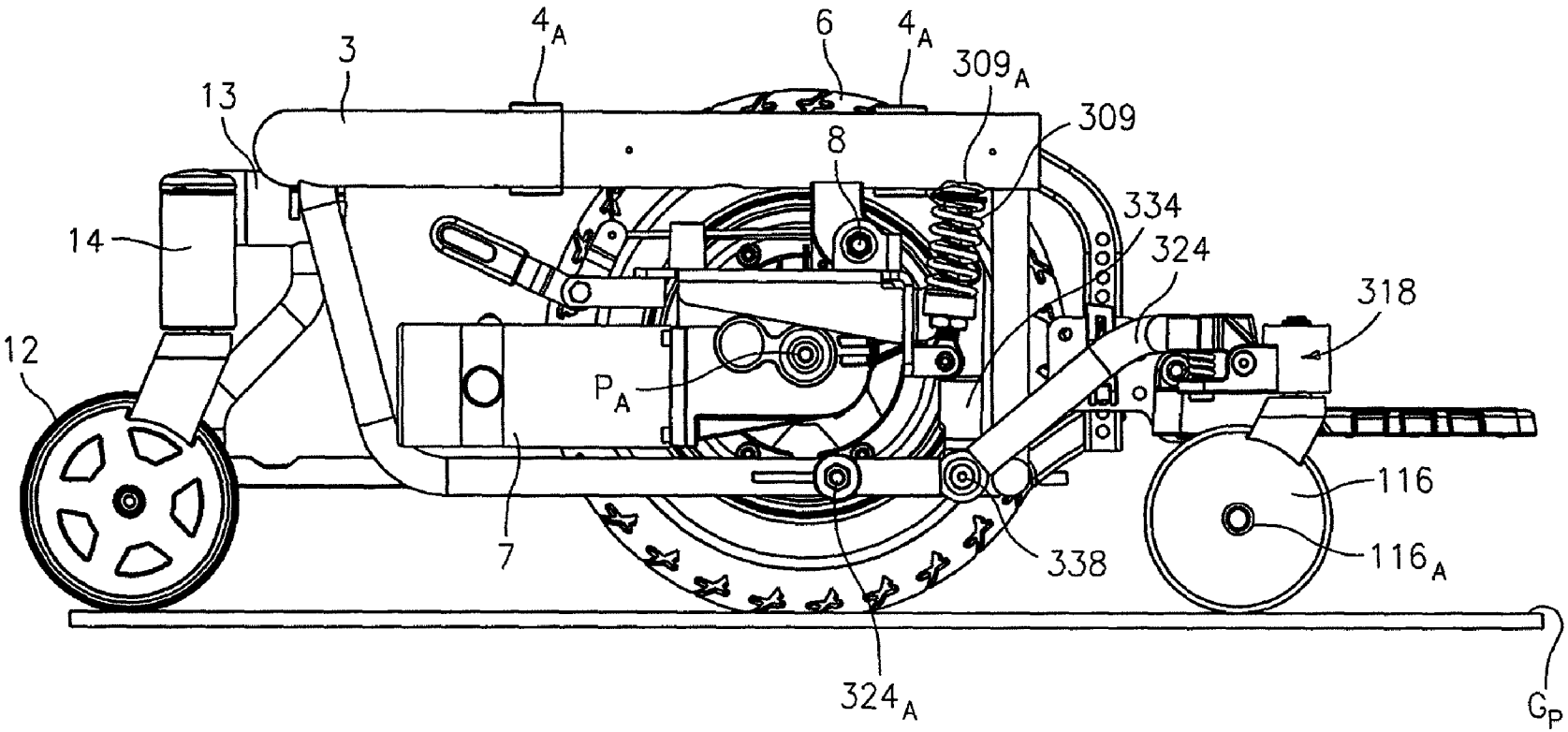
FIG. 21 is a partial side elevation of the wheelchair embodiment particularly shown in FIGS. 12-14, having the near drive wheel removed to illustrate the relationship between the various links and pivots.
Figure 22:
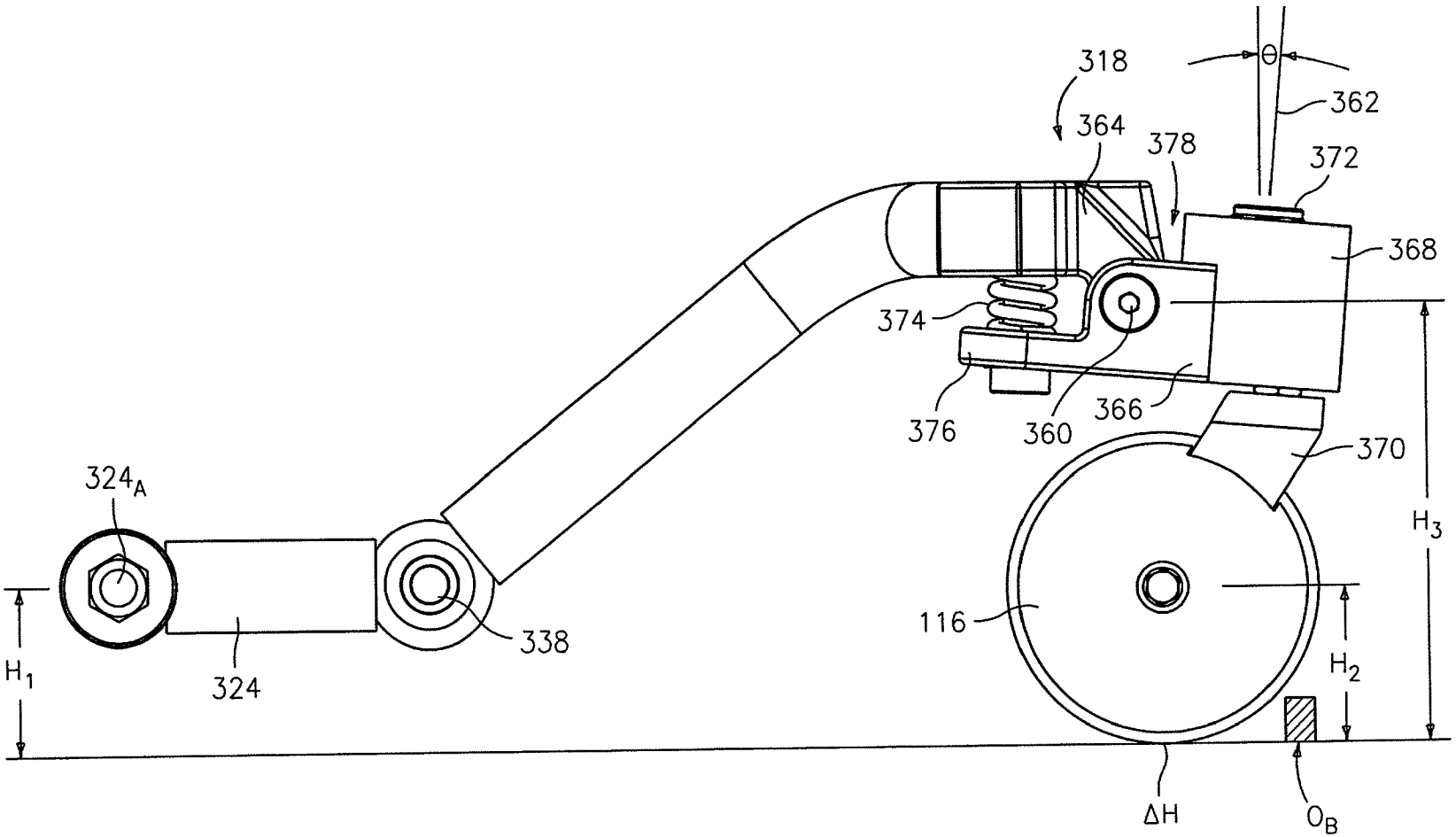
FIG. 22 is a partial side elevation of the suspension arm structure and the anti-tip caster assembly of the embodiment shown in FIG. 21.

There is illustrated in FIGS. 21 and 22 a side view of various portions of the vehicle 302 as previously described with respect to FIGS. 12-14. As is readily apparent from the prior figures, the suspension arm 324 is mounted at pivot $\mathbf{324}_A$ on the vehicle frame 3 at a position relatively below the pivotal mounting 8 of the drive train assembly 7 and also below the pitch axis $P_A$, which forms the axis of rotation for the drive wheel 6. The first link 334 connects the bracket 358 to the suspension arm 324. The pivotal connection 342 between the drive train 7 and the first link 334 is adjacent the pivotal mounting 8 of the drive train 7 to the frame 3. Similarly, the pivotal connection 338 of the first link 334 with the suspension arm 324 is adjacent the suspension arm pivot $\mathbf{324}_A$ on the frame 3. In addition, the connection between the anti-tip wheel 116 and the suspension arm 324 is formed at the flexible mount 318. The flexible mount 318 is positioned relatively above, with reference to the ground plane $G_P$, the suspension pivot $\mathbf{324}_A$. This relationship is more particularly illustrated in FIG. 22.

In FIG. 22 there is illustrated the suspension arm 324 portion of the vehicle 302. The suspension pivot $\mathbf{324}_A$ is fixed to the vehicle frame (3, FIG. 21) at a height designated as $H_1$. The anti-tip axle $\mathbf{116}_A$ is positioned at a height $H_2$, with the pivot 360 for the flexible mount 318 positioned at a different height $H_3$. In FIG. 22, the anti-tip wheel 116 is shown having engaged an obstacle $O_B$ causing the flexible mount 318 to move rearwardly towards the suspension pivot $\mathbf{324}_A$ and a deflection of the anti-tip wheel about the mounting pivot 360. This deflection is illustrated as an angle θ with respect to the normal vertical position of the caster axis 362 about which the anti-tip wheel pivots. This slight angular deflection θ causes a lifting of the anti-tip wheel 116 off of the ground plane $G_P$ and an increase in height ΔH of the wheel axle $\mathbf{116}_A$. (Thus, the height $H_2$ is normally the diameter of the anti-tip wheel 116. When an angular deflection 8 occurs upon engagement of an obstacle $O_B$, prior to the pivoting of the suspension arm 324 about the suspension aiin pivot $\mathbf{324}_A$, the axle $\mathbf{116}_A$ is at a slightly greater height than the diameter of the wheel, which in this embodiment rides on the ground.) The flexible mount 318 generally comprises a fixed member 364, which is formed at the projected end of the suspension arm 324. The mounting pivot 360 comprises the coupling between the rotational member 366 and the fixed member 364. The rotational member 366 is fixed to the caster barrel 368, which forms the caster swivel axis 362. A fork 370 is attached to a spindle 372 formed within the caster barrel 368. The fork supports the caster wheel 116, while permitting rotation of the wheel about the axle $\mathbf{116}_A$. (Other forms of caster type wheels and anti-tip wheels may also be used.) A spring 374 (or other resilient means) is formed between a flange 376 and the underside of the fixed member 364. The resilient force of the spring 374 normally moves the flange 376 counterclockwise (as seen in FIG. 22) about the mounting pivot 360 and positions the spindle 372 and its corresponding caster swivel axis 362 in a substantially vertical position. A stop is formed between the caster barrel 368 and the fixed member 364 to fix the normal position of the flexible mount and, thus, stop rotation of the member 366 about the pivot 360. Upon engagement of an obstacle $O_B$ by the wheel 116, a force is generated toward the suspension pivot $\mathbf{324}_A$, causing rotation of the member 366 about the pivot 360 against the spring 374, causing compression of the spring and permitting the wheel to more easily ride over the obstacle $O_B$. Upon the force created by the obstacle $O_B$ on the wheel 116 reaching an equilibrium with the force of the spring 374, the suspension arm 324 will pivot counterclockwise (as seen in FIG. 22) about the suspension pivot $\mathbf{324}_A$.

The moment arm created by the anti-tip wheel 116 about the flexible mount pivot 360 is greater than the moment created about the suspension pivot $\mathbf{324}_A$. The initial movement is for the anti-tip wheel 116 to move rearwardly upon engagement of an obstacle $O_B$, prior to the lifting of the suspension arm 324. This relationship is a function of the height $H_3$ of the mounting pivot 360 being greater than the height $H_1$ of the suspension pivot $\mathbf{324}_A$ and the restoration force of the spring 374. The relationship between these elements permit the suspension to flex resiliently in response to various sized obstacles without substantially affecting the position of the wheelchair occupant.

The form of the flexible mount 318 as illustrated is contemplated to meet the needs of the present invention. However, other embodiments of a flexible mount for an anti-tip wheel assembly are contemplated. Examples of caster type assemblies include, but are not limited to, commonly assigned U.S. Pat. Nos. 6,543,798 and 6,796,658, which are herein incorporated by reference. Alternatively, a Rosta™ type bearing may be utilized to mount and support the anti-tip wheel on the suspension arm.

Figure 23A:
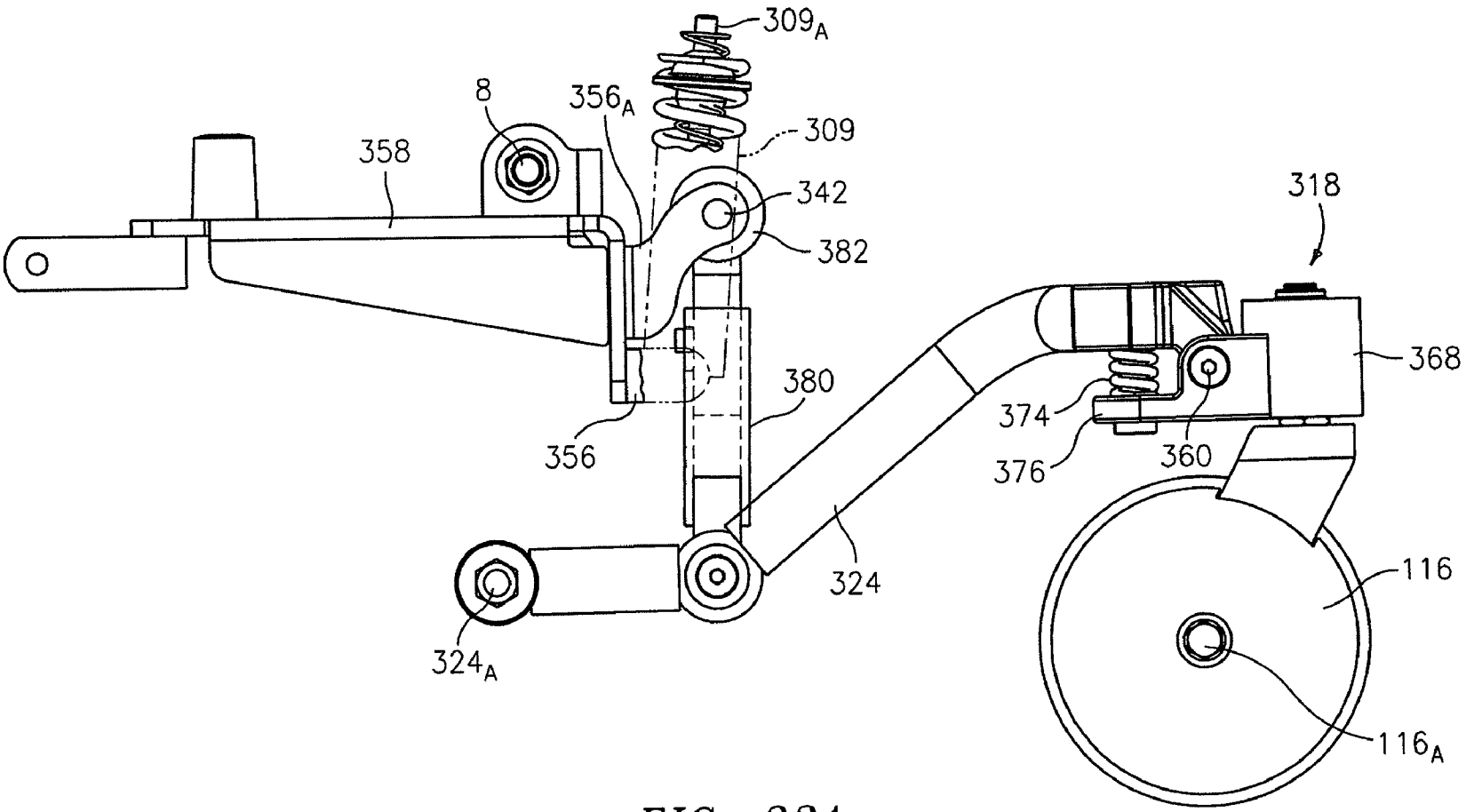
FIGS. 23A-D show various views of a collapsible link connecting the drive train assembly and the suspension arm within the structures of the present invention.

In FIGS. 23A-D there is illustrated a variation of the anti-tip suspension illustrated in FIGS. 12-14, 21 and 22. As illustrated in FIG. 23A, a suspension arm 324 is mounted to the vehicle frame (not shown in this Figure) at suspension pivot $\mathbf{324}_A$. The suspension arm projects outwardly from the pivot and terminates in a flexible mount 318, comprising the fixed member 364, the rotational member 366 and the spring 374. The rotational member 366 supports the anti-tip wheel 116. The drive train mounting plate 358 is pivotally supported on the frame at pivot 8 and includes a bracket 356 for supporting the suspension spring 309 (shown broken away) which at its upper end $\mathbf{309}_A$ is supported by the frame. In the present embodiment, the rigid link 334 in the prior figures has been replaced by a resilient link 380, which permits a limited contraction in length of the link upon the application of certain forces on the suspension arm 324 created by the drive train (not shown in this figure).

Figure 23D:
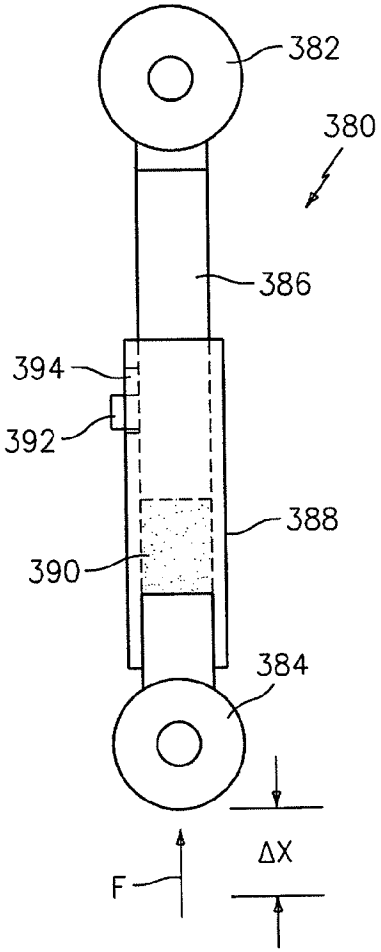
Figure 23C:
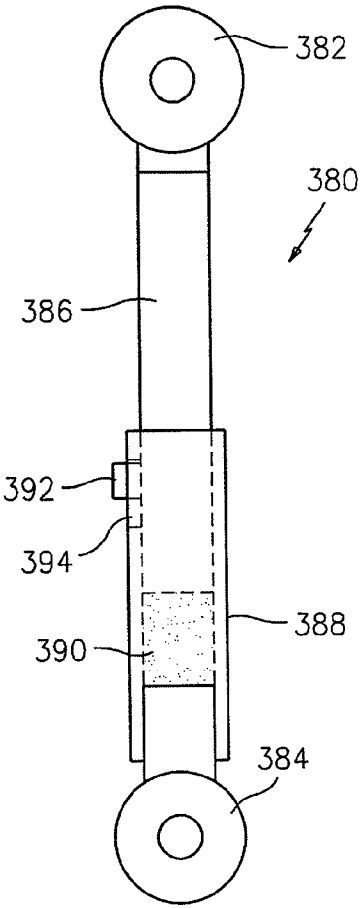
Figure 23B:
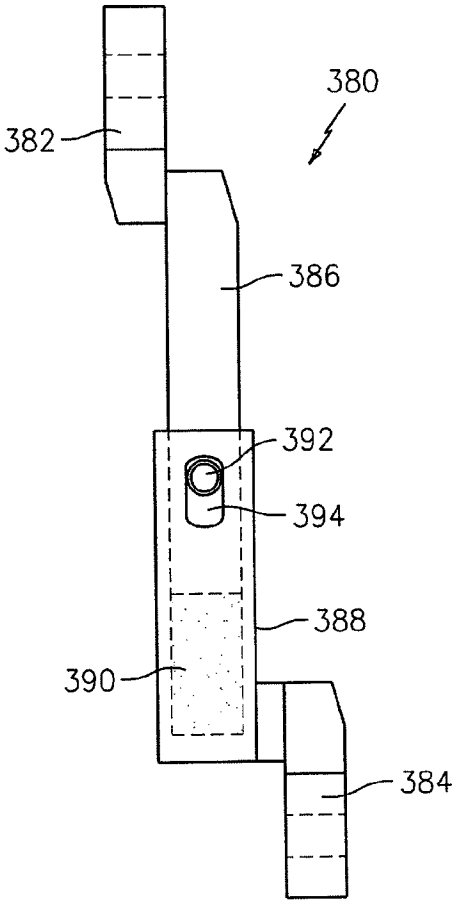

One construction of the flexible link 380 is more particularly illustrated in FIGS. 23A-D. In FIG. 23B the link 380 includes an upper mounting loop 382 and a lower mounting loop 384. The upper loop 382 is contemplated to be fixed to the bracket $\mathbf{356}_A$ at pivot 342. The lower loop 384 forms the attachment of the link 380 to the suspension arm 324 at the lower pivot 338. Attachment to the brackets and suspension arm may be formed by any type fastener. Extending between the loops 382, 384 is a first member 386, which is telescopingly received within a second member 388. A resilient member 390, such as an elastomeric material, is provided within the internal space of the second member, between the lower end of the first member 386 and the bottom wall of the second member 388. A pin 392 is formed on the first member and projects outwardly through a slot 394 formed in the second member 388. The resilient member 390 exerts a force on the first member 386 such that the pin 392 is positioned at the upper end of the slot 394 in the normal rest position. The projection of the pin 392 through the wall of the slot 394 is more particularly illustrated in FIG. 23C.

As illustrated in FIG. 23D, upon a force F being exerted on the link 380, the loops 382 and 384 move closer together such that the length of the link 380 is reduced by an amount $\Delta X$. The reduction in length of the link 380 is permitted by the compression of the resilient member 390. Thus, the force F must be sufficient to overcome the restoration force of the resilient member 390.

In normal operation, the force F may be created by a number of actions within the suspension structure of the vehicle. First, the anti-tip wheel 116 may engage an obstacle (such as obstacle $O_B$ in FIG. 22) sufficient to cause pivoting of the suspension arm 324 about the suspension pivot $\mathbf{324}_A$. Depending on the operative position of the drive train and the position of the drive wheels, the link 380 will be reduced in length prior to a significant force being applied to the drive train mounting plate through bracket $\mathbf{356}_A$. Alternatively, the torque created by the drive train mounting plate about the pivot axis $P_A$ (see FIGS. 12, 14 and 21) may also cause a reaction within the suspension through the link 380. In the condition illustrated in FIG. 14, whereby a rotational torque causing the drive train assembly to pivot counterclockwise, the engagement of the pin 392 with the slot 394 prevents the link 380 from increasing in length and thus the rotation of the drive train causes the link to lift the suspension arm 324 and anti-tip wheel 116. In a situation where the torque operates in the opposite direction, due to deceleration of the vehicle or travel on a downward slope, the drive train creates a force in the clockwise direction as illustrated in FIG. 23A. The link 380 attempts to move downwardly along with the pivoting of the drive train mounting bracket about the pivot 8. Since the anti-tip wheel 116 is positioned on the ground, the suspension arm will not move further downwardly. Thus, the first member 386 compresses the resilient member 390, while the second member 388 remains relatively fixed with respect to the ground plane.

It should be understood that the flexible link 380 as illustrated in FIGS. 23A-D may be applied to any of the embodiments illustrated in the application. The linked connection between the drive train and the suspension arm that supports the anti-tip wheel is common in each of the embodiments.

Further, it should be understood that the relationship in height of the flexible mount with respect to the height of the pivot for the suspension is also common through the various embodiments illustrated in, at least, FIGS. 12-20. Variations in the flexible link structure will become apparent to those who have skill in the art upon reviewing the parameters discussed herein. The resilient and/or resistive force within the link may be created by a number of devices, such as a spring, an elastomeric material, a hydraulic fluid or any combination thereof.

A variety of other modifications to the structures particularly illustrated and described will be apparent to those skilled in the art after review of the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A powered vehicle comprising:

a frame;

a seat mounted on the frame;

a pair of drive wheels positioned on opposing sides of the frame;

a drive motor assembly operatively coupled to at least one of the drive wheels for powering rotation of the drive wheel about a drive wheel axis and for powering movement of the vehicle across a ground plane;

at least one anti-tip assembly comprising a suspension arm pivotably mounted to the frame at a suspension arm pivot axis, said suspension arm extending from said suspension arm pivot axis outwardly from the frame, said suspension arm pivot axis vertically spaced above the ground plane, and an anti-tip wheel having a rotational axis about which the anti-tip wheel rotates, said anti-tip wheel disposed on the extended suspension arm, the vertical position of the suspension arm pivot axis with respect to the ground plane in normal operation being spaced from and positioned relatively below a line drawn between the drive wheel axis and the rotational axis of the anti-tip wheel; and a resilient link operatively connecting the drive motor assembly to the suspension arm, wherein, in response to torque created by the motor in rotating the drive wheel, the drive motor assembly pivots and causes, through the operative connection of the resilient link, the suspension arm to pivot about the suspension arm pivot axis, and a responding vertical movement of the anti-tip wheel.

2. The vehicle of claim 1 wherein the drive motor assembly is pivotably mounted on the frame and wherein the drive motor assembly pivots about the mounting in response to the torque created in rotating the at least one drive wheel.

3. The vehicle of claim 2 wherein the pivotal coupling of the drive motor assembly to the frame is at a position substantially vertically aligned with the suspension arm pivot axis.

4. A vehicle as claimed in claim 1 wherein the resilient link has a fixed maximum length and is resiliently compressible.

5. The vehicle of claim 1 wherein the anti-tip axis in normal operation of the vehicle is spatially located at a vertical position with respect to the ground plane substantially equal to or above the vertical position of the suspension arm pivot axis relative to the ground plane.

6. A vehicle comprising:

a frame;

a pair of drive wheels defining a drive wheel axis;

at least one rear wheel;

a drive motor assembly pivotably coupled to the frame at a position relatively above the drive wheel axis, and operatively coupled to at least one drive wheel for powering the rotation of the drive wheel about the drive wheel axis and for powering movement of the vehicle across a ground plane; and at least one anti-tip assembly comprising a suspension arm pivotably mounted to the frame at a suspension arm pivot axis that is vertically spaced above the ground plane, and an anti-tip wheel disposed proximate to an end of the suspension arm, and including an anti-tip wheel having a rotational axis about which the anti-tip wheel rotates, wherein the vertical position of the suspension arm pivot axis with respect to the ground plane in normal operation is spaced from and positioned relatively below a line drawn between the drive wheel axis and the rotational axis of the anti-tip wheel, and wherein suspension arm is operative coupled to the drive motor assembly such that the suspension arm pivots in response to torque created by the rotation of the at least one drive wheel by the drive motor assembly and results in a responsive vertical movement of the end of the suspension arm and the anti-tip wheel.

7. The vehicle of claim 6 further comprising linkage means operatively connecting the drive motor assembly to the suspension arm for operatively transferring the torque responsive pivotal movement of the drive motor assembly to the suspension arm.

8. The vehicle of claim 6 wherein the pivotal coupling of the drive motor assembly to the frame is substantially vertically aligned with the suspension arm pivot axis.

9. A vehicle comprising:

a frame;

a pair of drive wheels defining a drive wheel axis;

at least one rear wheel;

a drive motor assembly pivotably coupled to the frame and operatively coupled to each drive wheel for powering the rotation of the drive wheels about the drive wheel axis and for powering movement of the vehicle across a ground plane; and at least one anti-tip assembly comprising a suspension arm pivotably mounted to the frame at a suspension arm pivot axis that is vertically spaced above the ground plane, and an anti-tip wheel disposed proximate to an end of the suspension arm, and including an anti-tip wheel having a rotational axis about which the anti-tip wheel rotates, wherein (i) the vertical position of the suspension arm pivot axis with respect to the ground plane in normal operation is spaced from and positioned relatively below a line drawn between the drive wheel axis and the rotational axis of the anti-tip wheel, and (ii) the drive motor assembly is pivotably coupled to the frame at a position vertically above the position on the frame of the suspension arm pivot axis, and wherein the suspension arm is operatively coupled to the drive motor assembly, such that the suspension arm pivots in response to torque created by the rotation of the drive wheel by the drive motor assembly and causing a responsive vertical reaction of the end of the suspension arm and the anti-tip wheel.

10. The vehicle of claim 9 comprising linkage means operatively connecting the drive motor assembly to the suspension arm for operatively transferring the torque responsive movement of the drive motor assembly to the suspension arm.

11. The vehicle of claim 9 wherein the pivotal coupling of the drive motor assembly to the frame is located vertically above the drive wheel axis.

12. The vehicle of claim 9 wherein the pivotal coupling of the drive motor assembly to the frame is substantially vertically aligned with the suspension arm pivot axis.

13. A vehicle powered for movement across a ground plane, the vehicle comprising:

a frame;

a seat mounted on the frame;

a pair of drive wheels on opposing sides of the frame;

a drive assembly pivotably attached to the frame and operatively coupled to at least one of the drive wheels for powering rotation of the at least one drive wheel and movement of the vehicle across the ground plane;

at least one anti-tip assembly comprising a suspension arm having a suspension arm pivot axis, the suspension arm extending forward of the frame from the suspension arm pivot axis; said suspension arm pivot axis being vertically spaced above the ground plane to define a suspension arm pivot height, the pivotal attachment of the drive assembly to the frame being positioned vertically above the suspension arm pivot axis, and an anti-tip caster wheel disposed proximate the extended end of the suspension arm; and a suspension link connecting the drive assembly to the suspension arm, the suspension link operatively transferring to the suspension arm the motion of the drive assembly about its pivotal mounting in response to the torque created in rotation of the drive wheels, the suspension link having a fixed maximum length and being resiliently compressible.

14. A vehicle as in claim 13 wherein the pivotal coupling of the drive assembly to the frame is substantially vertically aligned with the suspension arm pivot axis.

15. The vehicle of claim 14 wherein the pivotal coupling of the drive assembly to the frame is located vertically above an axis defined by the pair of drive wheels.

16. The vehicle of claim 15 wherein the vertical position of the suspension arm pivot axis with respect to the ground plane in normal operation is spaced from and positioned relatively below a line drawn between the axis defined by the pair of drive wheels and a rotational axis of the anti-tip caster wheel.

17. A vehicle comprising:

a frame;

a pair of drive wheels defining a drive wheel axis;

at least one rear wheel;

a drive assembly operatively coupled to at least one drive wheel for powering the rotation of the at least one drive wheel about the drive wheel axis and for powering movement of the vehicle across a ground plane; and at least one anti-tip assembly comprising a suspension arm pivotably mounted to the frame at a suspension arm pivot axis that is vertically spaced above the ground plane, and an anti-tip wheel disposed proximate to an end of the suspension arm and including a rotational axis about which the anti-tip wheel rotates, wherein the vertical position of the suspension arm pivot axis with respect to the ground plane in normal operation is spaced from and positioned relatively below a line drawn between the drive wheel axis and the rotational axis of the anti-tip wheel, and wherein the suspension arm is operatively coupled to the drive assembly such that the suspension arm pivots about the suspension arm pivot axis in response to torque created by rotation of the at least one drive wheel by the drive assembly resulting in a responsive vertical movement of the end of the suspension arm and the anti-tip wheel.

18. A vehicle as in claim 17 wherein the drive assembly is pivotally coupled to the frame at a drive assembly pivot axis that is substantially vertically aligned with the suspension arm pivot axis.

19. The vehicle of claim 18 wherein the pivotal coupling of the drive assembly to the frame is located vertically above an axis defined by the pair of drive wheels.

20. The vehicle of claim 19 further comprising a suspension link connecting the drive assembly to the suspension arm, the suspension link operatively transferring to the suspension arm the motion of the drive assembly about its pivotal mounting in response to the torque created in rotation of the drive wheels.

21. The vehicle of claim 20 wherein the suspension link has a fixed maximum length and is resiliently compressible.

* * * * *